US009599939B2

(12) United States Patent
Shibuya

(10) Patent No.: US 9,599,939 B2
(45) Date of Patent: Mar. 21, 2017

(54) IMAGE FORMING APPARATUS WITH DIFFERENT FIXING TEMPERATURES FOR EACH SIDE IN DUPLEX FIXING

(71) Applicant: KONICA MINOLTA, INC., Chiyoda-ku (JP)

(72) Inventor: Satoru Shibuya, Chiryu (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/561,628

(22) Filed: Dec. 5, 2014

(65) Prior Publication Data

US 2015/0160594 A1 Jun. 11, 2015

(30) Foreign Application Priority Data

Dec. 11, 2013 (JP) ..... 2013-256413

(51) Int. Cl.
*G03G 15/20* (2006.01)
*G03G 15/23* (2006.01)

(52) U.S. Cl.
CPC ..... *G03G 15/205* (2013.01); *G03G 15/2039* (2013.01); *G03G 15/2078* (2013.01); *G03G 15/231* (2013.01)

(58) Field of Classification Search
CPC ..... G03G 15/2039; G03G 15/2078; G03G 15/205
USPC ..... 399/69, 67
See application file for complete search history.

(56) References Cited

U.S. PATENT DOCUMENTS

2008/0170872 A1* 7/2008 Kobayashi ..... G03G 15/2039 399/69
2010/0054788 A1* 3/2010 Mukai ..... G03G 15/5004 399/70
2012/0207495 A1* 8/2012 Sakuraba ..... G03G 15/2046 399/44

FOREIGN PATENT DOCUMENTS

JP 54-092749 A 7/1979
JP 11-338300 A 12/1999
JP 2002-023555 A 1/2002
JP 2002023555 A * 1/2002
JP 2004-317603 A 11/2004
JP 2006-071908 A 3/2006
JP 2012-242751 A 12/2012
(Continued)

OTHER PUBLICATIONS

Notification of Reasons for Refusal issued in corresponding Japanese Patent Application No. 2013-256413, mailed Nov. 25, 2015, with English translation; 10 pages.

*Primary Examiner* — Benjamin Schmitt
(74) *Attorney, Agent, or Firm* — Buchanan Ingersoll & Rooney PC

(57) ABSTRACT

An image forming apparatus includes an image carrier to carry a toner image. A transfer unit transfers the toner image to a sheet. A fixing unit fixes the toner image on the sheet. The sheet with the image is discharged to a sheet discharge tray. A circular conveyance path turns over the sheet past the transfer unit and the fixing unit and passes the sheet through the transfer unit and the fixing unit again. A heat amount setting section sets an amount of heat applied by the fixing unit when fixing of the sheet is executed. In duplex printing, a first heat amount for fixing the toner image on a first side of the sheet is smaller than a reference heat amount for simplex printing whereas a second heat amount for fixing
(Continued)

the toner image on a second side of the sheet is larger than the reference heat amount.

20 Claims, 22 Drawing Sheets

(56) References Cited

FOREIGN PATENT DOCUMENTS

JP 2013-238654 A 11/2013

* cited by examiner

IMAGE FORMING APPARATUS WITH DIFFERENT FIXING TEMPERATURES FOR EACH SIDE IN DUPLEX FIXING

CROSS-REFERENCE TO RELATED APPLICATIONS

The present application claims priority under 35 U.S.C. §119 to Japanese Patent Application No. 2013-256413, filed Dec. 11, 2013. The contents of this application are incorporated herein by reference in their entirety.

BACKGROUND OF THE INVENTION

Field of the Invention

The present invention relates to an image forming apparatus.

Discussion of the Background

In an image forming apparatus of electrophotography, a toner image formed on an image carrier is transferred to a recording sheet at a transfer unit, and the recording sheet is heated and pressurized at a fixing unit to fix the toner image on the recording sheet in order to perform image formation. At the transfer unit, a transfer voltage is applied to a transfer roller to transfer electrified toner from the image carrier to the recording sheet. At the fixing unit, when heated by a heating roller, the toner, which has been transferred to the recording sheet at the transfer unit, is melted and fixed on the recording sheet by a pressurizing roller.

There has been known an image forming apparatus in which a recording sheet having a first side on which an image is formed (printed) as described above is circulated inside of the apparatus. This enables image formation on the second side of the recording sheet as well, thus performing duplex printing of the recording sheet (see Japanese Unexamined Patent Application Publication No. 2004-317603). When the image forming apparatus recited in Japanese Unexamined Patent Application Publication No. 2004-317603 performs duplex printing, a fixing temperature for the first-side printing is controlled to have an optimum value to prevent the recording sheet, which has been printed on the first side, from curling. Also, there has been disclosed a technique to the effect that, based on gradation processing with respect to an image to be formed on a recording sheet and its gradation value, a fixing temperature that enables fixing on the recording sheet is set (see Japanese Unexamined Patent Application Publication No. 2012-242751).

The contents of Japanese Unexamined Patent Application Publication No. 2004-317603 and Japanese Unexamined Patent Application Publication No. 2012-242751 are incorporated herein by reference in their entirety.

Due to an influence of the transfer voltage, an electric discharge may occur at a transfer nip area in the transfer unit. Such an electric discharge in the transfer unit may cause electric discharge noise called white dots in an image formed on a recording sheet. These white dots on the image formed on the recording sheet are generated in a state in which an electric discharge is liable to occur, for example, when a sheet resistance of the recording sheet is large and when a toner electrification amount is high. In the case of duplex printing, heat for fixing in the first-side printing decreases the moisture of the recording sheet to increase the sheet resistance. Therefore, white dots are liable to be generated in the second-side printing. Moreover, in recent years, there has been a demand for increasing the conveyance speed, and consequently, the transfer voltage at the transfer unit is increased to cause white dots more likely.

In the image forming apparatus recited in Japanese Unexamined Patent Application Publication No. 2004-317603, the fixing temperature for the first-side printing is controlled to have an optimum value to prevent a conveyance failure at the time of the second-side printing due to curling of the recording sheet. However, the fixing temperature for the second-side printing is constant. Consequently, depending on the fixing temperature set for the first-side printing, an amount of heat applied to the recording sheet may be insufficient as compared with a heat amount required for duplex printing. This may unfortunately cause a fixing defect. In the image forming apparatus recited in Japanese Unexamined Patent Application Publication No. 2012-242751, the fixing temperature is controlled to have an optimum value when simplex printing is repeated. However, when the image forming apparatus is applied to duplex printing, the fixing temperature becomes high at the time of the first-side printing. This increases the resistance of the recording sheet in the second-side printing, which may cause electric discharge noise.

In view of these problems, it is an object of the present invention to provide an image forming apparatus that eliminates or minimizes electric discharge noise at the time of duplex printing and applies a sufficient amount of heat for fixing to a recording sheet.

SUMMARY OF THE INVENTION

According to one aspect of the present invention, an image forming apparatus is configured to perform simplex printing for printing only a first side of a recording sheet and to perform duplex printing for printing the first side and a second side of the recording sheet. The image forming apparatus includes an image carrier, a transfer unit, a fixing unit, a sheet discharge tray, a circular conveyance path, and a heat amount setting section. The image carrier is configured to carry a toner image. The transfer unit is configured to transfer the toner image on the image carrier to a recording sheet. The fixing unit is configured to fix the toner image, which has been transferred at the transfer unit, on the recording sheet. The recording sheet on which the image is formed is discharged to the sheet discharge tray. The circular conveyance path is configured to turn over the recording sheet that has been passed through the transfer unit and the fixing unit, and to pass the recording sheet through the transfer unit and the fixing unit again. The heat amount setting section is configured to set an amount of heat applied by the fixing unit when fixing of the recording sheet is executed. In the duplex printing, a heat amount for fixing the toner image on the first side of the recording sheet is set to be smaller than a heat amount for the simplex printing. A heat amount for fixing the toner image on the second side of the recording sheet is set to be larger than the heat amount for the simplex printing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS (General Arrangement of Image Forming Apparatus)

Figure 1:
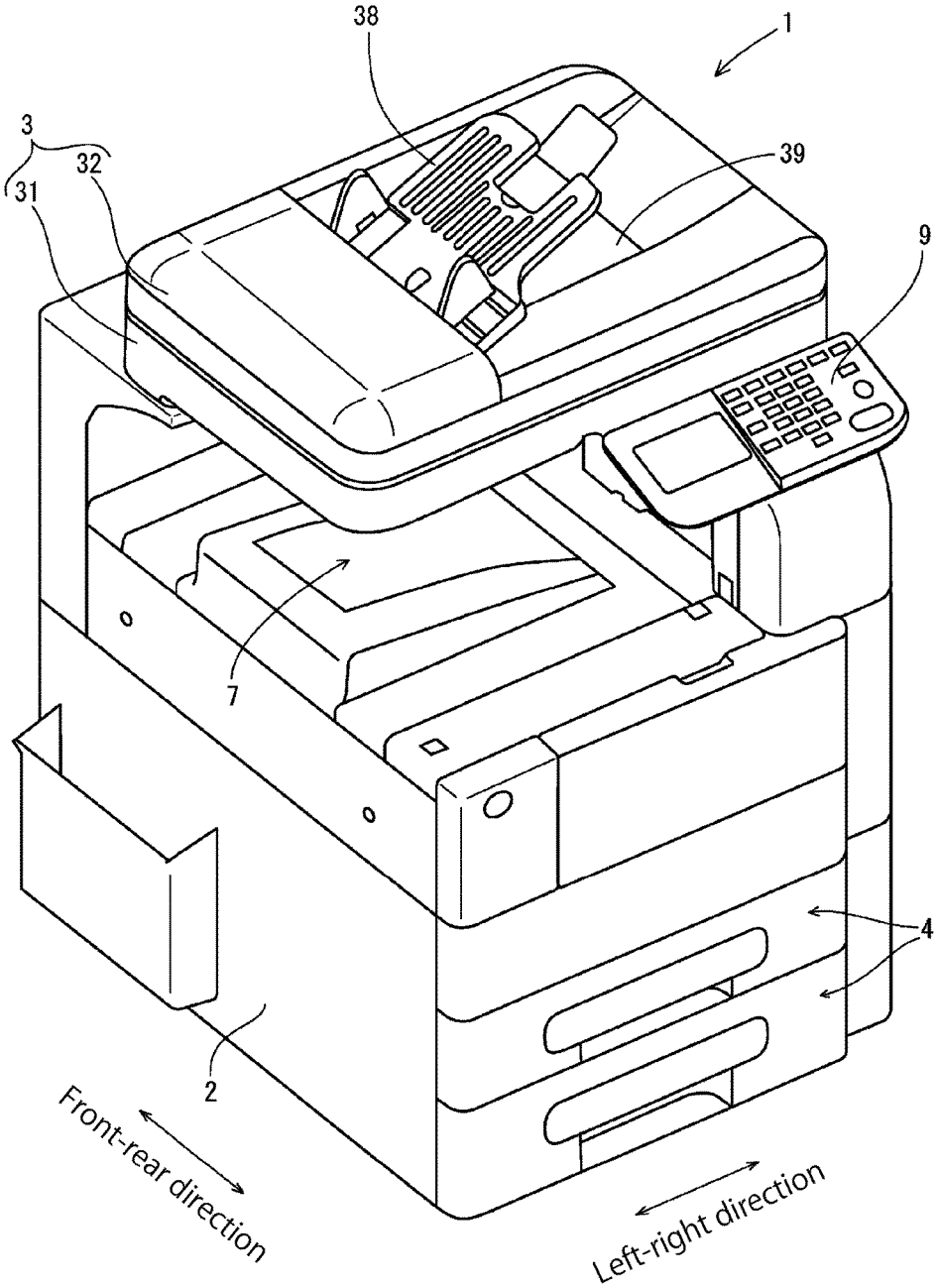
FIG. 1 is an external perspective view of an image forming apparatus according to the present invention.
Figure 2:
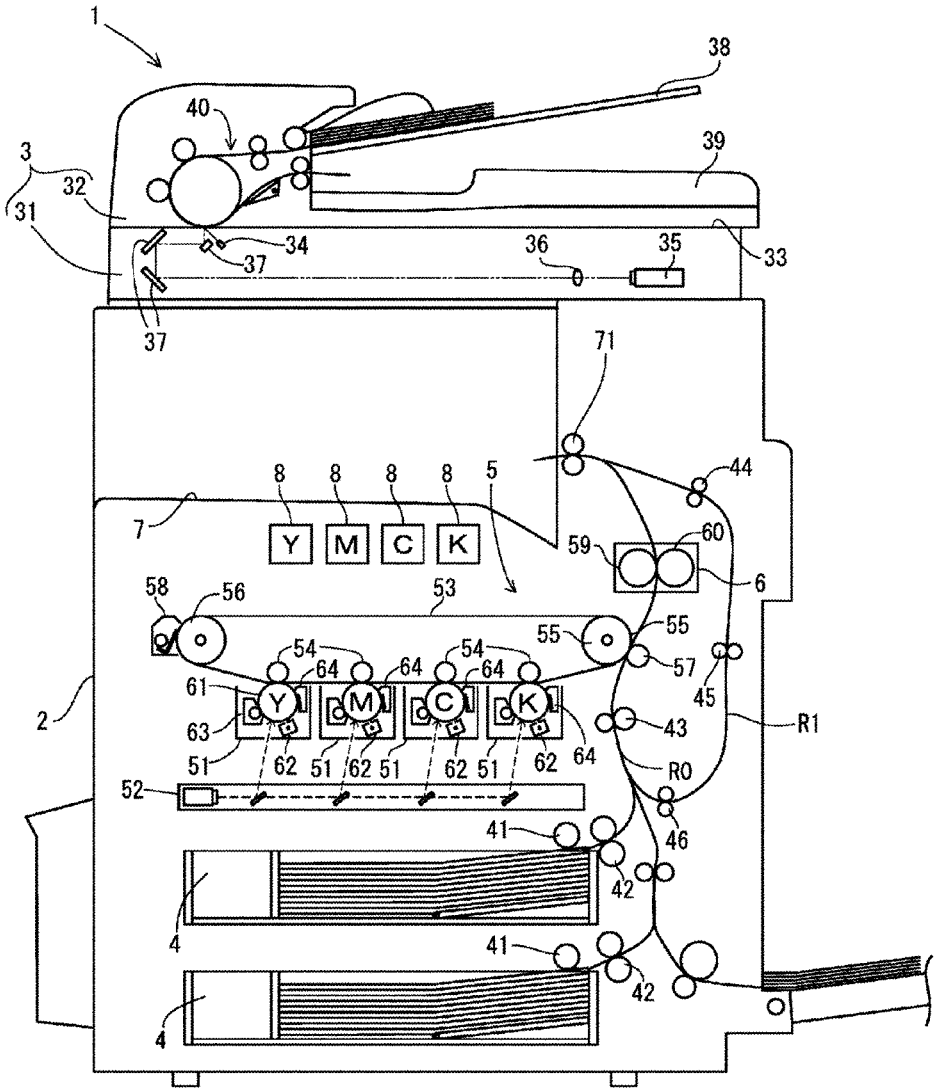
FIG. 2 is a schematic diagram illustrating an internal configuration of the image forming apparatus shown in FIG. 1.

The general arrangement of an image forming apparatus according to an embodiment of the present invention will be described below with reference to the drawings. FIG. 1 is an external perspective view of the image forming apparatus. FIG. 2 is a schematic diagram illustrating an internal configuration of the image forming apparatus.

As shown in FIGS. 1 and 2, the image forming apparatus 1 includes an image reader 3, sheet feeders 4, a transfer unit 5, a fixing unit 6, a sheet discharge tray 7, toner feeders 8, and an operation panel 9. The image reader 3 reads an image from a document. The sheet feeders 4 contain recording sheets on which images are to be formed. The transfer unit 5 forms a toner image and transfers the toner image to each recording sheet fed from the sheet feeder 4. The fixing unit 6 fixes the toner image transferred to the recording sheet by the transfer unit 5. The recording sheet on which the image is fixed and formed at the fixing unit 6 is discharged to the sheet discharge tray 7. The toner feeders 8 feed toner to developers 63 in the transfer unit 5. The operation panel 9 receives operation commands to the image forming apparatus 1. In the image forming apparatus 1, the image reader 3 is disposed on an upper portion of an apparatus main body 2. Inside of the apparatus main body 2, as shown in FIG. 1, the sheet feeders 4, the transfer unit 5, and the fixing unit 6 are disposed in sequence from the bottom.

The sheet discharge tray 7 is disposed on an upper side of the apparatus main body 2 so as to receive the recording sheet discharged after the image is recorded at the fixing unit 6. The sheet feeders 4 are detachably inserted below the transfer unit 5 in the apparatus main body 2. In this configuration, a recording sheet contained in the sheet feeder 4 is fed into the apparatus main body 2 and conveyed upwardly. An image is formed on the recording sheet in the transfer unit 5 and the fixing unit 6 above the sheet feeder 4. The recording sheet is discharged to the sheet discharge tray 7 disposed in a space (recessed space) below the image reader 3.

The image reader 3 on the upper portion of the apparatus main body 2 includes a scanner 31 and an automatic document feeder (ADF) 32. The scanner 31 reads an image from a document. The ADF 32 is disposed on an upper portion of the scanner 31 and feeds documents to the scanner 31 one by one. The scanner 31 includes a document table 33, a light source (light emission unit) 34, an image sensor (light reception unit) 35, an image formation lens 36, and a mirror group 37. The document table 33 includes platen glass (not shown) on an upper surface thereof. The light source 34 irradiates a document with light. The image sensor 35 performs photoelectric conversion of reflected light from the document into image data. The image formation lens 36 forms an image of the reflected light on the image sensor 35. The mirror group 37 reflects the reflected light from the document successively to make the reflected light incident on the image formation lens 36. The ADF 32 includes a document mounting tray 38 and a document discharge tray 39. On the upper side of the scanner 31, the ADF 32 is disposed to be openable from the document table 33 in a cantilever manner.

When the image reader 3 reads a document on the platen glass (not shown) of the document table 33, the light source 34 moving in a subscanning direction irradiates the document with light. Through the mirror group 37 and the image formation lens 36, an image of the reflected light is formed on the image sensor 35. Thus, the image sensor 35 generates an electric signal based on the reflected light from the document, and outputs the electric signal as image data. When the image reader 3 reads a document on the document mounting tray 38, the light source 34 and the mirror group 37 are fixed at predetermined positions inside of the document table 33. The document is conveyed to a reading position by a document conveyance mechanism 40 including components such as a plurality of rollers. Therefore, the document, which has been conveyed by the document conveyance mechanism 40, is irradiated with the light from the light source 34, and an image of the reflected light is formed on the image sensor 35 to output image data.

The transfer unit 5 includes image formation portions 51, an exposure portion 52, an intermediate transfer belt 53, primary transfer rollers 54, a drive roller 55, a driven roller 56, a secondary transfer roller 57, and a cleaner 58. The image formation portions 51 respectively generate toner images of colors of yellow (Y), magenta (M), cyan (C), and key tone (K). The exposure portion 52 is disposed below the image formation portions 51. The intermediate transfer belt 53 is in contact with the image formation portions 51 for the colors disposed horizontally. The toner images of the colors are transferred from the image formation portions 51 to the intermediate transfer belt 53. The primary transfer rollers 54 are respectively disposed above and opposite to the image formation portions 51 of the colors in such a manner that the primary transfer rollers 54 and the image formation portions 51 clamp the intermediate transfer belt 53. The drive roller 55 rotates the intermediate transfer belt 53. Rotation of the drive roller 55 is transmitted to the driven roller 56 through the intermediate transfer belt 53 to rotate the driven roller 56. The secondary transfer roller 57 is disposed opposite to the drive roller 55 with the intermediate transfer belt 53 interposed therebetween. The cleaner 58 is disposed opposite to the driven roller 56 with the intermediate transfer belt 53 interposed therebetween.

Each of the image formation portions 51 includes a photosensitive drum 61, an electrifier 62, the developer 63, and a cleaner 64. The photosensitive drum 61 is in contact with an outer peripheral surface of the intermediate transfer belt 53. The electrifier 62 electrifies an outer peripheral surface of the photosensitive drum 61 by corona discharge. After stirring and electrifying toner, the developer 63 applies the toner to the outer peripheral surface of the photosensitive drum 61. After the toner image is transferred to the intermediate transfer belt 53, the cleaner 64 removes residual toner on the outer peripheral surface of the photosensitive drum 61. The photosensitive drum 61 is disposed opposite to the primary transfer roller 54 with the intermediate transfer belt 63 interposed therebetween. The photosensitive drum 61 rotates clockwise, as seen in FIG. 2. Around the photosensitive drum 61, the primary transfer roller 54, the cleaner 64, the electrifier 62, and the developer 63 are disposed in sequence in the rotation direction of the photosensitive drum 61.

The intermediate transfer belt 53 is made of, for example, an endless belt member having electric conductivity, and wound around the drive roller 55 and the driven roller 56 without slackness. Thus, in accordance with rotation of the drive roller 55, the intermediate transfer belt 53 rotates counterclockwise, as seen in FIG. 2. Around the intermediate transfer belt 53, the secondary transfer roller 57, the cleaner 58, and the image formation portions 51 of the colors Y, M, C, and K are disposed in sequence in the rotation direction of the intermediate transfer belt 53. The toner feeders 8 containing toner of the colors Y, M, C, and K to be fed to the respective developers 63 are disposed on the upper side of the intermediate transfer belt 53. The toner feeders 8 are provided for the respective colors Y, M, C, and K, and coupled to the developers 63 of the respective colors Y, M, C, and K through toner conveyance members, not shown. The toner feeders 8 supply the toner to the developers 63 through the toner conveyance members.

Figure 3:
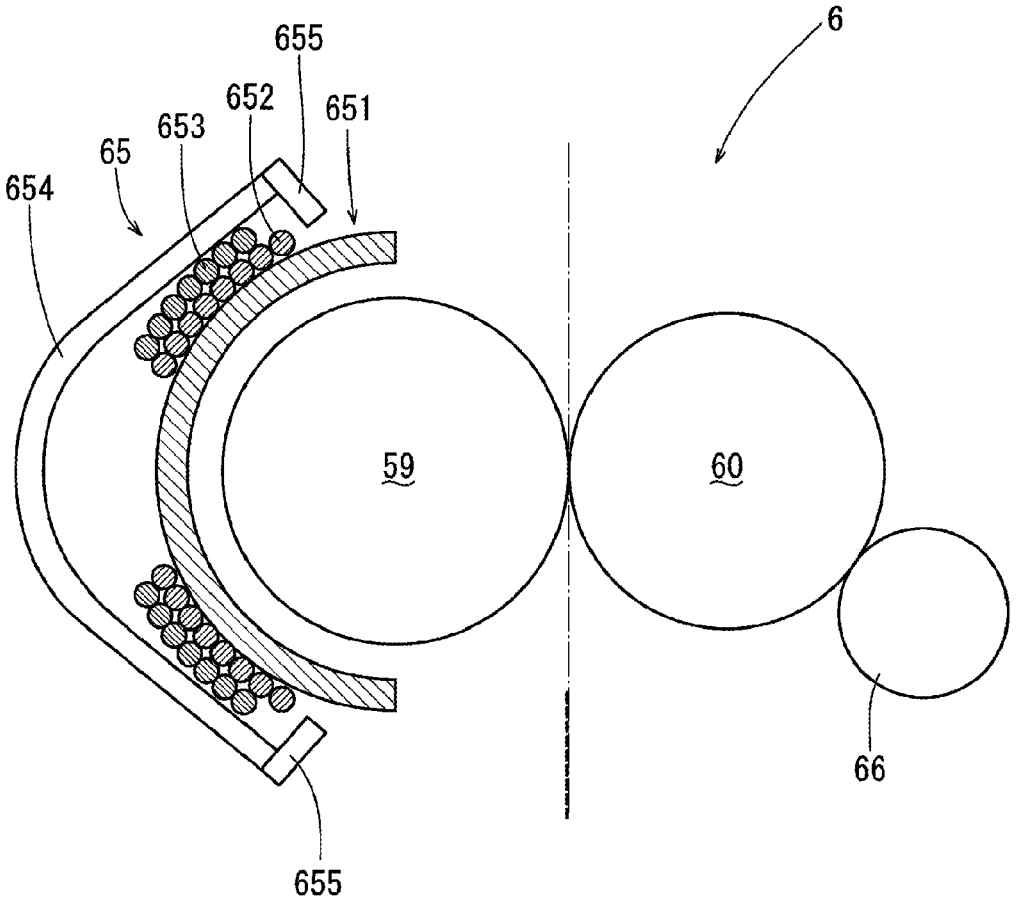
FIG. 3 is a schematic diagram illustrating a configuration of a fixing unit in the image forming apparatus shown in FIG. 1.

As shown in FIG. 3, the fixing unit 6 includes a heating roller 59 and a pressurizing roller 60. The heating roller 59 heats and fixes a toner image on a recording sheet. The pressurizing roller 60 clamps the recording sheet with the heating roller 59 and pressurizes the recording sheet. Also, the fixing unit 6 includes a magnetic flux producer 65 and a heat equalizing roller 66. The magnetic flux producer 65 produces eddy current on the surface of the heating roller 59 by electromagnetic induction. The heat equalizing roller 66 is in contact with the surface of the pressurizing roller 60 under pressure. Description is being made on an exemplary configuration in which the heating roller 59 and the pressurizing roller 60 constitute the fixing unit 6. In place of the heating roller 59, however, a heating belt may be adopted.

Figure 4:
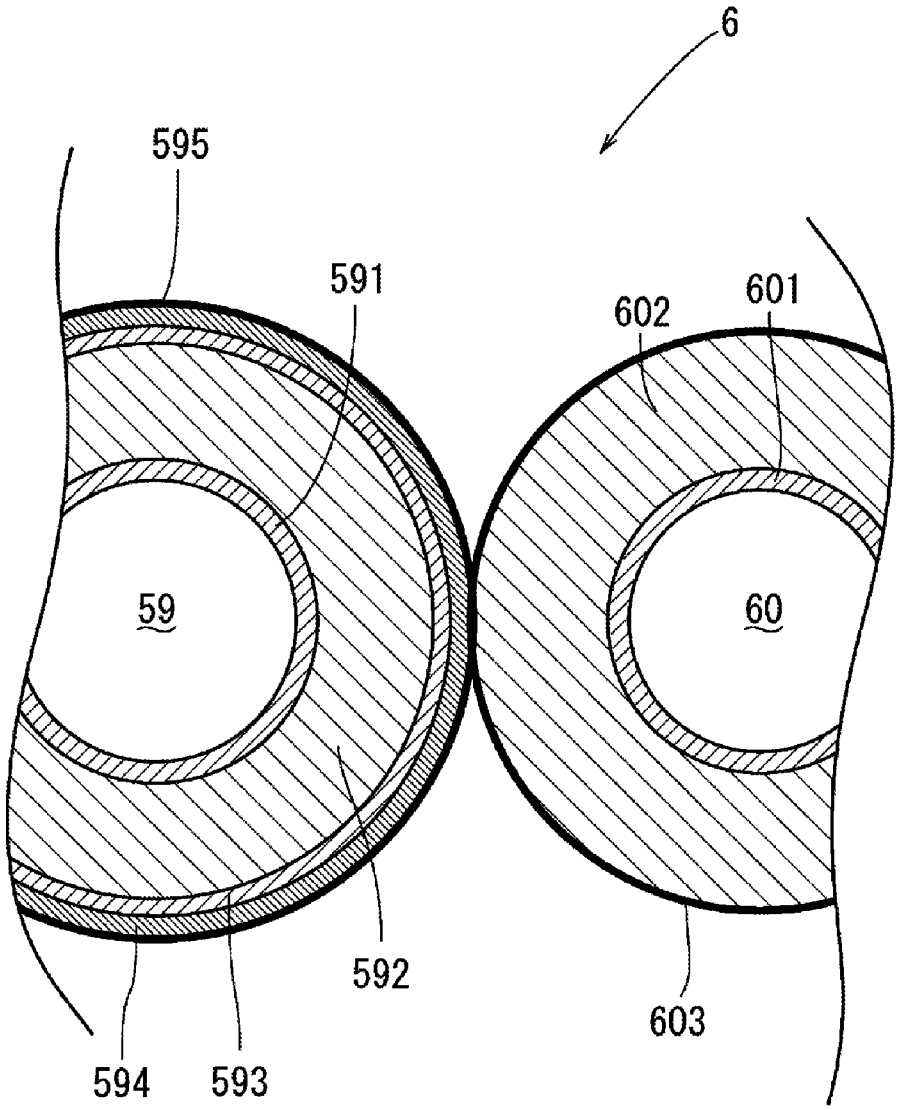
FIG. 4 is a partial cross-sectional view of the configuration of the fixing unit shown in FIG. 3.

As shown in FIG. 4, the heating roller 59 includes a cylindrical core 591 on an outer peripheral surface of which a heat insulating layer 592, an electromagnetic induction heating layer 593, an elastic layer 594, and a release layer 595 are laminated successively. The insulating layer 592 is made of a sponge form of heat resistant and elastic material (such as rubber and resin). The electromagnetic induction heating layer 593 generates Joule heat by excitation by the magnetic flux producer 65. The elastic layer 594 increases close contact between a recording sheet and the surface of the heating roller 59. The release layer 595 is made of heat resistant material to increase releasability of the surface of the heating roller 59. The pressurizing roller 60 includes a cylindrical core 601 on an outer peripheral surface of which a heat insulating layer 602 and a release layer 603 are laminated successively. The heat insulating layer 602 is made of a sponge form of heat resistant and elastic material (such as rubber and resin). The release layer 603 is made of heat resistant material to increase releasability of the surface of the pressurizing roller 60.

As shown in FIG. 3, the magnetic flux producer 65 includes an excitation coil 652, a demagnetization coil 653, a main core 654, and hem cores 655. The excitation coil 652 is wound around a coil bobbin 651. The demagnetization coil 653 is superposed on an end portion of the excitation coil 652. The main core 654 has a mountain-shaped cross-section and is disposed to cover the outer surface of the excitation coil 652 which is on the opposite side to the heating roller 59 side. The hem cores 655 are disposed on edges of the main core 654. Supplied with high frequency power, the excitation coil 652 generates magnetic flux. The magnetic flux induced by the excitation coil 652 passes the inside of the main core 654 and guided from the main core 654 to the heating roller 59. The main core 654 of high magnetic permeability and low loss increases the efficiency of the magnetic circuit and conducts magnetic blowout circuit breaking. The demagnetization coil 653 causes counter electromotive force to cancel magnetic field generated by the excitation coil 652 and suppresses heating of the heating roller 59.

The heat equalizing roller 66 is disposed opposite to the pressurizing roller 60 over the entire length, and is driven and rotated by the pressurizing roller 60. The heat equalizing roller 66 may contain a heat source such as a halogen lamp and a resistance heating element. It should be noted that the fixing unit 6 is not limited to the above-described configuration shown in FIG. 3. Heating may be conducted by the heating roller 59 that contains a heat source such as a halogen lamp.

A sheet feed mechanism to draw out recording sheets one by one from the sheet feeder 4 includes a draw roller 41 and a separation roller pair 42. The draw roller 41 draws out the recording sheets contained in the sheet feeder 4 from an uppermost sheet. The separation roller pair 42 separate the drawn recording sheets one from another. The draw roller 41 and the separation roller pair 42 are rotated to feed the recording sheets in the sheet feeder 4 one by one from an uppermost recording sheet to a main conveyance path R0.

In the main conveyance path R0, a conveyance roller pair (timing roller pair) 43 is disposed on the upstream side of the transfer unit 5. On the downstream side of the fixing unit 6, a sheet discharge roller pair 71 is disposed to discharge a printed recording sheet. A recording sheet is fed from the sheet feeder 4 to the main conveyance path R0. At a timing when a toner image on the intermediate transfer belt 53 is transferred to the recording sheet, the conveyance roller pair 43 is rotated to convey the recording sheet to a nip area (transfer area) between the intermediate transfer belt 53 and the secondary transfer roller 57. The printed recording sheet is discharged to the sheet discharge tray 7 by rotation of the sheet discharge roller pair 71.

In the apparatus main body 2 of the image forming apparatus 1, a circular conveyance path R1 is provided for turning a recording sheet over after simplex printing to subject the recording sheet to duplex printing. The sheet discharge roller pair 71 is rotatable in normal and reverse directions. When the sheet discharge roller pair 71 rotates in the normal direction, the recording sheet is discharged to the sheet discharge tray 7 outside the apparatus main body 2. When the sheet discharge roller pair 71 rotates in the reverse direction, the recording sheet is switched back (conveyed reversely) and conveyed again to the main conveyance path R0 through the circular conveyance path R1.

In the circular conveyance path R1, a conveyance roller pair 44 is provided for receiving the recording sheet reversed by the sheet discharge roller pair 71. On the downstream side of the conveyance roller pair 44, a conveyance roller pair 45 is provided. A conveyance roller pair 46 is provided on the upstream side of a connecting portion of the circular conveyance path R1 with the main conveyance path R0. While the sheet discharge roller pair 71 is rotated in the reverse direction, the conveyance roller pair 44 is rotated to convey the recording sheet switched back by the sheet discharge roller pair 71 to the circular conveyance path R1. Also, the conveyance roller pairs 45, 46 are rotated to convey the recording sheet in the circular conveyance path R1 until the recording sheet is conveyed to the main conveyance path R0 again.

As shown in FIG. 1, an operation panel 9 is disposed on the front side of the apparatus main body 2. The user operates the keys while looking at, for example, a monitor of the operation panel 9, in order to perform setting of a function selected from various kinds of functions of the image forming apparatus 1, and to instruct the image forming apparatus 1 to execute work.

(Printing Operation)

A printing operation by the image forming apparatus 1 will now be described briefly. The image forming apparatus 1 receives such signals as a start signal and an image signal through the operation panel 9 or an external terminal so as to start the printing operation. When the printing operation starts, a recording sheet fed from the sheet feeder 4 is conveyed to the image transfer unit 5 along the main conveyance path R0. In each of the image forming portions 51 of the colors Y, M, C, and K in the image transfer unit 5, the photosensitive drum 61 is electrified by the electrifier 62, and the surface of the photosensitive drum 61 is irradiated with a laser beam from the exposure portion 52. Thus, an electrostatic latent image corresponding to an image of the color Y, M, C, K is formed.

Toner electrified by the developer 63 is transferred to the surface of the photosensitive drum 61 on which the electrostatic latent image is formed, and a toner image is formed on the photosensitive drum 61. When the toner image carried on the surface of the photosensitive drum 61 is brought into contact with the intermediate transfer belt 53, the toner image is transferred to the intermediate transfer belt 53 by static electricity of the primary transfer roller 54. Consequently, the toner images of the colors Y, M, C, K superposed on each other are formed on the surface of the intermediate transfer belt 53. After the toner image is transferred to the intermediate transfer belt 53, the toner, which has not been transferred but remained on the photosensitive drum 61, is scraped by the cleaner 64 and removed from the surface of the photosensitive drum 61.

When the intermediate transfer belt 53 is rotated by the drive roller 55 and the driven roller 56, the toner image transferred to the intermediate transfer belt 53 moves to the transfer position in contact with the secondary transfer roller 57 and is transferred to a recording sheet conveyed to the transfer position on the main conveyance path R0. After the toner image is transferred to the recording sheet, the toner, which has not been transferred and remained on the intermediate transfer belt 53, is scraped by the cleaner 58 and removed from the surface of the intermediate transfer belt 53.

After the toner image is transferred to the recording sheet at a position in contact with the secondary transfer roller 57, the recording sheet is conveyed to the fixing unit 6. At this time, the recording sheet on one side of which the unfixed toner image is carried passes a fixing position of the fixing unit 6. Then, the recording sheet is heated and pressurized by the heating roller 59 and the pressurizing roller 60 to fix the unfixed toner image on the recording sheet.

In the case of simplex printing, after the toner image is fixed on the recording sheet (after simplex printing), the recording sheet passes the fixing unit 6, and is discharged to the sheet discharge tray 7 by rotation (rotation in the normal direction) of the sheet discharge roller pair 71. In the case of duplex printing, the recording sheet after simplex printing, which has been conveyed to the sheet discharge tray 7 side by the sheet discharge roller pair 71, is switched back by reverse rotation of the sheet discharge roller pair 71 and conveyed to the circular conveyance path R1. When the conveyance roller pairs 44 to 46 are rotated in the circular conveyance path R1, the recording sheet, which has been switched back for duplex printing, is turned over and returned to the main conveyance path R0 again. As the recording sheet passes the main conveyance path R0, the image transfer unit 5 and the fixing unit 6 transfer and fix a toner image on the other side of the recording sheet (the surface on which no toner image is fixed). Then, the sheet discharge roller pair 71 is rotated (rotated in the normal direction) to discharge the recording sheet after duplex printing to the sheet discharge tray 7.

Image forming apparatuses according to the following embodiments include the above-described configuration of the image forming apparatus 1 in common. The image forming apparatuses according to the following embodiments are different in duplex printing operations. Consequently, detailed description will be made on configurations and processings in relation to duplex printing in the following embodiments.

First Embodiment

Figure 5:
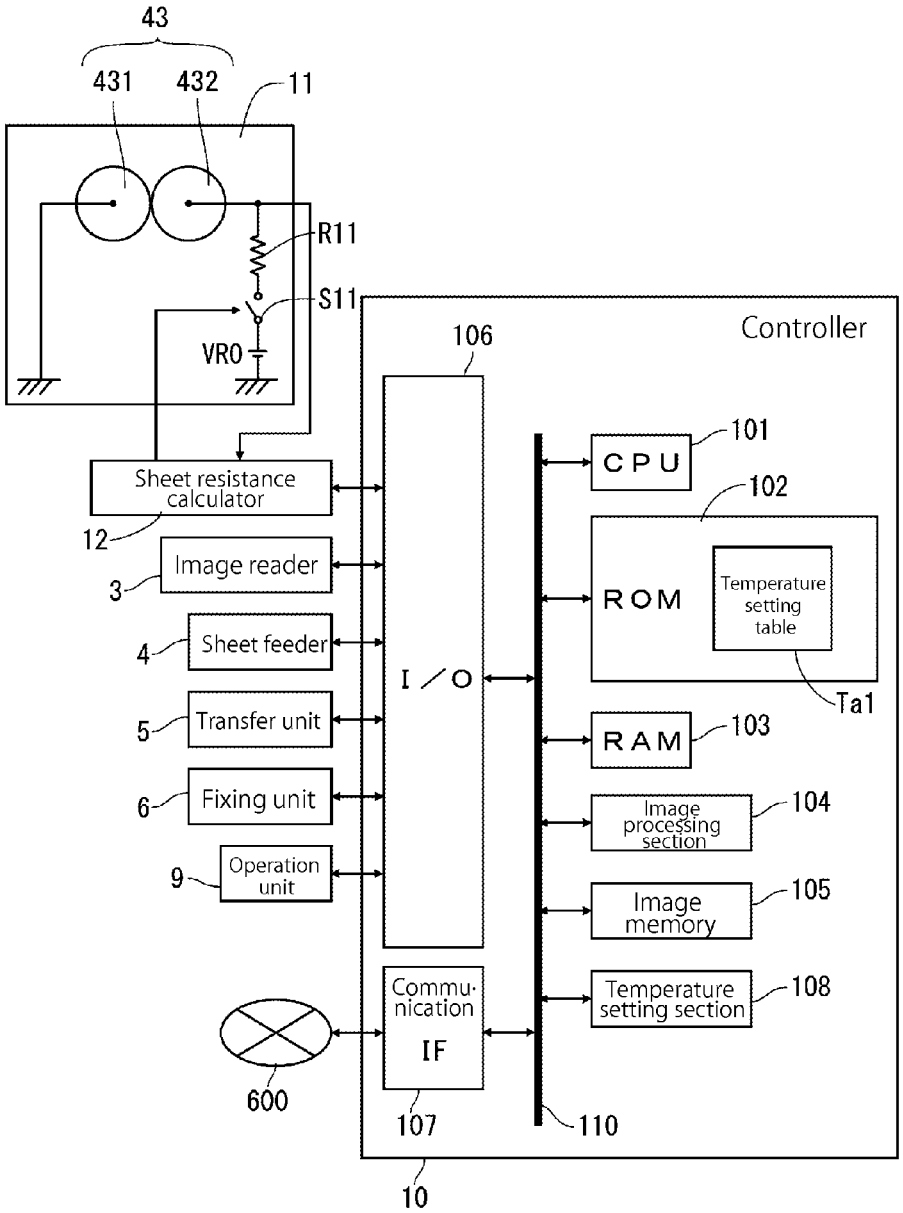
FIG. 5 is a block diagram illustrating a configuration of a controller of an image forming apparatus according to a first embodiment of the present invention.
Figure 7:
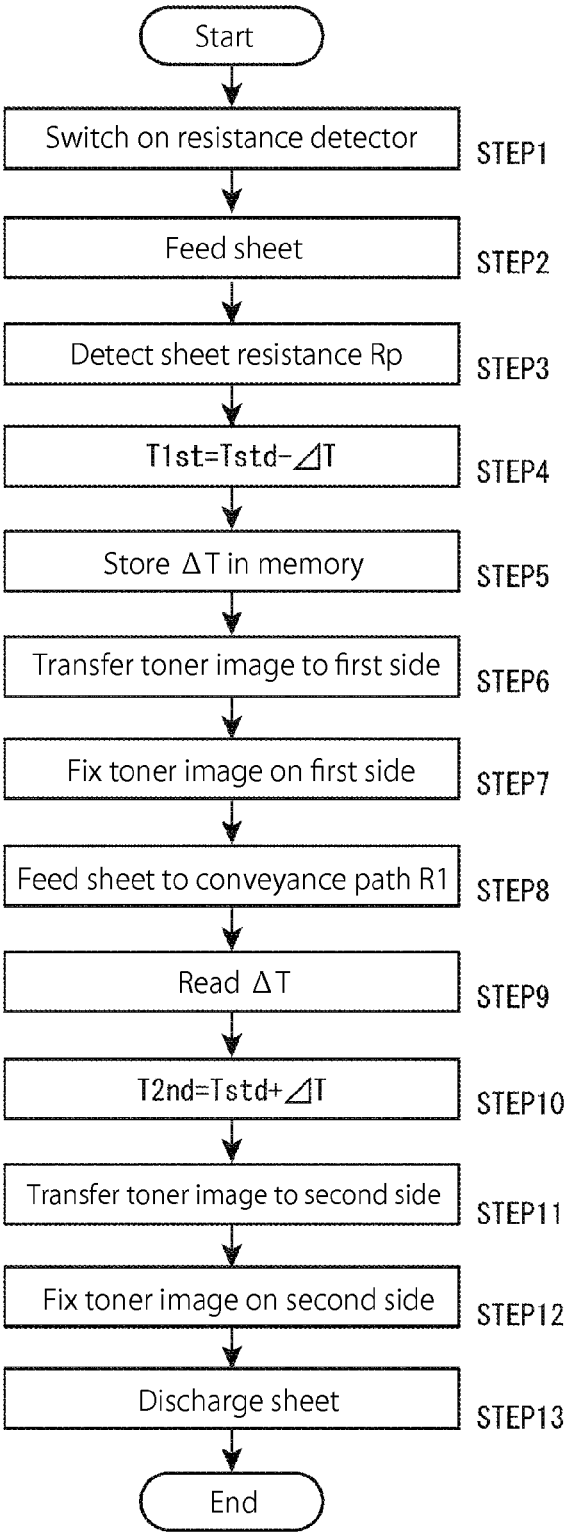
FIG. 7 is a flowchart illustrating a control operation at the time of duplex printing by the image forming apparatus according to the first embodiment of the present invention.

An image forming apparatus according to a first embodiment of the present invention will now be described with reference to the drawings. FIG. 5 is a schematic block diagram illustrating a configuration of a controller of the image forming apparatus according to the first embodiment. FIG. 7 is a flowchart illustrating a control operation at the time of duplex printing. It should be noted that the general arrangement of the image forming apparatus according to the first embodiment includes the above-described configuration shown in FIGS. 1 and 2.

As shown in FIG. 5, the image forming apparatus 1 according to the first embodiment includes a sheet resistance detector 11 to detect a sheet resistance of a recording sheet passing the timing roller pair 43. The sheet resistance detector 11 makes one roller 431 of the timing roller pair 43 grounded. The sheet resistance detector 11 includes a resistor R11 and a switch S11. One end of the resistor R11 is connected with the other roller 432 of the timing roller pair 43. The switch S11 has one end connected to the other end of the resistor R11, and a DC voltage VR0 is applied to the other end of the switch S11. Therefore, when the switch S11 is turned on, and when the sheet resistance of the recording sheet passing the timing roller pair 43 is a resistance value Rp, the sheet resistance detector 11 uses a resistance value R11 of the resistor R11 and outputs a divided voltage value VR0×Rp/(R11+Rp) as a resistance detection signal.

Also, the image forming apparatus 1 includes a sheet resistance calculator 12 to calculate a sheet resistance Rp of the recording sheet based on the resistance detection signal input from the sheet resistance detector 11. The sheet resistance calculator 12 notifies the controller 10 of the detected sheet resistance Rp. The sheet resistance calculator 12 controls connection/disconnection (ON/OFF) of the contact of the switch S11 in the sheet resistance detector 11. Therefore, for example, when a recording sheet is fed from the sheet feeder 4 to the main conveyance path R0, the switch S11 is turned on by the sheet resistance calculator 12, and consequently, the sheet resistance of the recording sheet is detected by the sheet resistance detector 11. Thus, only when the recording sheet passes the timing roller pair 43, the sheet resistance detector 11 is operated to suppress power consumption in the detecting operation to the minimum.

The image forming apparatus 1 further includes the controller 10 having the configuration shown in FIG. 5. The controller 10 controls the components of the image forming apparatus 1 and executes various kinds of work such as printing of a recording sheet and image reading from a document. The controller 10 includes a central processing unit (CPU) 101, a read only memory (ROM) 102, a random access memory (RAM) 103, an image processing section 104, an image memory 105, an input/output interface 106, a communication interface 107, a temperature setting section (fixing heat amount setting section) 108, and a bus 110. The CPU 101 executes various kinds of processing and control. The ROM 102 stores control programs. The RAM 103 temporarily stores processing data. The image processing section 104 generates image data on which a toner image to be formed in the transfer unit 5 is based. The image memory 105 temporarily stores the image data acquired in the image processing section 104. The input/output interface 106 transmits and receives signals to and from the components of the image forming apparatus 1. The communication interface 107 communicates with an external network 600. The temperature setting section 108 sets a fixing temperature in the fixing unit 6. The bus 110 transmits and receives signals to establish communications between the blocks in the controller 10.

In the controller 10 of the above-described configuration, based on the sheet resistance Rp of a recording sheet notified from the sheet resistance calculator 12, the temperature setting section 108 sets a temperature difference (fixing temperature change amount) ΔT of a fixing temperature of first-side printing and a fixing temperature of second-side printing in duplex printing processing from a reference fixing temperature Tstd. The reference fixing temperature Tstd is a fixing temperature in simplex printing processing and serves as a reference value. The ROM 102 includes a temperature setting table Ta1 illustrating a relationship of the fixing temperature change amount ΔT with respect to the sheet resistance Rp, and stores the reference fixing temperature Tstd. The RAM 103 temporarily stores the fixing temperature change amount ΔT calculated by the temperature setting section 108. Consequently, the temperature setting section 108 reads the fixing temperature change amount ΔT from the RAM 103, and sets a fixing temperature of first-side printing T1st (=Tstd−ΔT) and a fixing temperature of second-side printing T2nd (=Tstd+ΔT).

Figure 6:
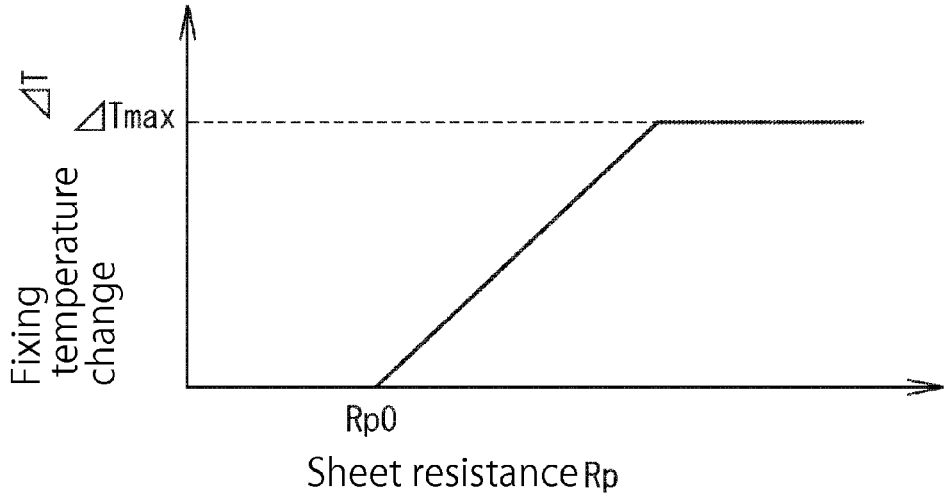
FIG. 6 is a graph illustrating a configuration of a temperature setting table stored in the controller shown in FIG. 5.

The temperature setting table Ta1 stored in the ROM 102 stores the relationship between the sheet resistance Rp and the fixing temperature change amount ΔT, which is illustrated in FIG. 6. When duplex printing is performed at the reference fixing temperature Tstd, while dots (electric discharge noise) at an unallowable level may occur at the time of second-side printing. When a value of the sheet resistance Rp at the time of occurrence of white dots is assumed a resistance value Rp0, the fixing temperature change amount ΔT is increased as the sheet resistance Rp becomes larger than the resistance value Rp0.

The maximum value ΔTmax of the fixing temperature change amount ΔT is set in such a manner that when fixing is conducted at the fixing temperature of the first-side printing corrected by the maximum value ΔTmax, toner is not detached from the toner image formed on the first side. That is, when the fixing temperature T1st is set at a temperature Tstd−ΔTmax, this temperature Tstd−ΔTmax becomes equal to or larger than a glass transition temperature of the toner. Therefore, a heat amount in the case of setting at the fixing temperature Tstd−ΔTmax becomes a value to supply a heat amount equal to or larger than the glass transition temperature of the toner to the toner transferred to the recording sheet.

The control operation of duplex printing by the controller 10 will be described below with reference to the flowchart shown in FIG. 7. When the input/output interface 106 or the communication interface 107 receives a signal indicating a start of the duplex printing operation, the controller 10 turns on the switch S11 of the sheet resistance detector 11 through the sheet resistance calculator 12 so as to start a detecting operation of a sheet resistance Rp of a recording sheet (STEP 1). Then, the controller 10 drives the feed roller 41 and the separation roller pair 42 of the sheet feeder 4 to feed the recording sheet to the main conveyance path R0 (STET2).

The recording sheet fed from the sheet feeder 4 is conveyed upwardly in the main conveyance path R0 and reaches the timing roller pair 43. When the recording sheet passes the timing roller pair 43, the sheet resistance detector 11 outputs, to the sheet resistance calculator 12, a resistance detection signal of a voltage signal based on the sheet resistance Rp of the recording sheet. Thus, based on the resistance detection signal from the sheet resistance detector 11, the sheet resistance calculator 12 calculates a sheet resistance Rp of the recording sheet fed from the sheet feeder 4 to the main conveyance path R0, and notifies the controller 10 (STEP 3). The controller 10 gives the sheet resistance Rp of the recording sheet received in the input/output interface 106 to the temperature setting section 108.

Referring to the temperature setting table Ta1 in the ROM 102, the temperature setting section 108 acquires a fixing temperature change amount ΔT based on the sheet resistance Rp. Subtracting the fixing temperature change amount ΔT from the reference fixing temperature Tstd, the temperature setting section 108 sets the temperature Tstd−ΔT as a fixing temperature T1st of the first-side printing (STEP 4). The fixing temperature T1st of the first-side printing set at the temperature setting section 108 is notified from the controller 10 to the fixing unit 6. The temperature setting section 108 acquires the fixing temperature change amount ΔT when setting the fixing temperature T1st of the first-side printing, and stores the acquired fixing temperature change amount ΔT in the RAM 103 temporarily (STEP 5).

Next, conveyed by the timing roller pair 43, the recording sheet reaches a transfer nip area of the transfer unit 5. A secondary transfer voltage is applied to the secondary transfer roller 57, and a toner image on the intermediate transfer belt 53 is transferred to a first side of the recording sheet (STEP 6). Prior to the secondary transfer to the recording sheet, the controller 10 controls the transfer unit 5 to drive the image formation portions 51 and the exposure portion 52 of the transfer unit 5 first and to form toner images on the photosensitive drums 61 in the image formation portions 51 of the colors Y, M, C, K. Then, the drive roller 55 is rotated, and a primary transfer voltage is applied to the primary transfer roller 56. Consequently, the toner image of the colors Y, M, C, K are transferred from the photosensitive drums 61 to the intermediate transfer belt 53. Thus, when the secondary transfer voltage is applied at STEP 6, the toner image on the intermediate transfer belt 53 is transferred to the recording sheet.

After the toner image is transferred to the first side of the recording sheet in the transfer unit 5, the recording sheet is conveyed to the fixing unit 6 through the main conveyance path R0. The fixing unit 6 receives the set fixing temperature T1st from the controller 10, and heats the conveyed recording sheet at the fixing temperature T1st while pressurizing it at the same time. Thus, the toner image is fixed on the first side of the recording sheet (STEP 7). After the toner image is fixed on the first side of the recording sheet, the recording sheet is conveyed to the sheet discharge roller pair 71 through the main conveyance path R0. The controller 10 controls the sheet discharge roller pair 71 to rotate in the normal direction and convey the recording sheet to the sheet discharge tray 7 side. Then, the sheet discharge roller pair 71 rotates in the reverse direction to switch back and convey the recording sheet to the circular conveyance path R1 (STEP 8). In the circular conveyance path R1, the controller 10 controls the conveyance roller pairs 44 to 46 to rotate and convey the recording sheet switched back by the sheet discharge roller pair 71 to the main conveyance path R0. Consequently, in the main conveyance path R0, the second side (rear side of the first side) of the recording sheet is to be printed.

In the controller 10, the temperature setting section 108 reads the fixing temperature change amount ΔT stored in the RAM 103 at STEP 5 (STEP 9). The temperature setting section 108 sets a fixing temperature T2nd of the second-side printing (STEP 10). Specifically, the temperature setting section 108 adds the fixing temperature change amount ΔT to the reference fixing temperature Tstd stored in the ROM 102, and sets the sum Tstd+ΔT as the fixing temperature T2nd of the second-side printing. The fixing temperature T2nd of the second-side printing set in the temperature setting section 108 is notified to the fixing unit 6 by the controller 10.

Next, the recording sheet conveyed to the main conveyance path R0 is conveyed to the transfer unit 5 by the timing roller pair 43. Similarly to STEP 6, a secondary transfer voltage is applied to the secondary transfer roller 57 to transfer a toner image on the intermediate transfer belt 53 to the second side of the recording sheet (STEP 11). After the toner image is transferred to the second side of the recording sheet, the recording sheet is conveyed to the fixing unit 6. Then, the fixing unit 6 heats the recording sheet at the fixing temperature T2nd while pressurizing the recording sheet at the same time to fix the toner image on the second side of the recording sheet (STEP 12). Thus, the toner image is fixed on both sides of the recording sheet, and the recording sheet is conveyed to the sheet discharge roller pair 71 through the main conveyance path R0. Then, the sheet discharge roller pair 71 rotates in the normal direction to discharge the recording sheet to the sheet discharge tray 7 (STEP 13).

Figure 8:
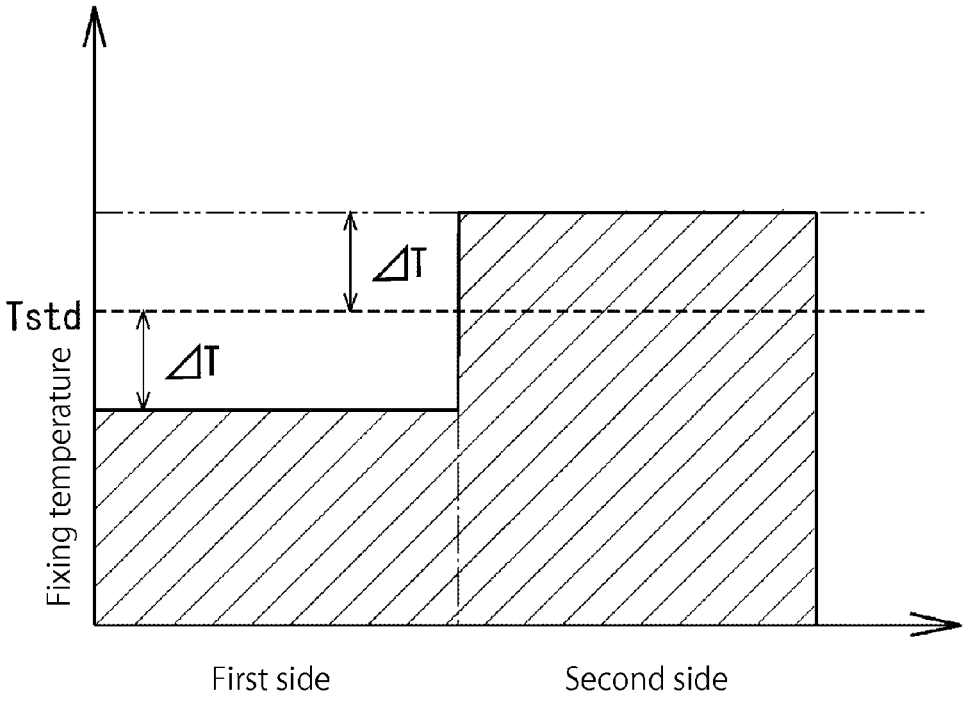
FIG. 8 is a graph illustrating a relationship of fixing temperatures for duplex printing.

As described above, in the duplex printing, the controller 10 controls operations of the components in accordance with the flowchart shown in FIG. 7 in such a manner that the fixing temperature T1st for the first side and the fixing temperature T2nd for the second side are set at the optimum values in accordance with the sheet resistance Rp of the recording sheet. Specifically, as shown in FIG. 8, the fixing temperature T1st for the first side is set to be lower than the reference fixing temperature Tstd by the fixing temperature change amount ΔT (0≤ΔT≤ΔTmax). This prevents an excessive decrease of moisture content of the recording sheet. Therefore, a decrease of the sheet resistance of the recording sheet at the time of the second-side printing is minimized to suppress occurrence of while dots (electric discharge noise) in the second-side printing. The fixing temperature T2nd for the second side is set to be higher than the reference fixing temperature Tstd by the fixing temperature change amount ΔT, and consequently, insufficiency of the heat amount due to a decrease of the fixing temperature for the first side is compensated for to improve a fixing state of the toner images on both sides of the recording sheet. When duplex printing is performed at the fixing temperatures T1 st and T2nd in this manner, a heat amount equivalent to a heat amount for performing simplex printing at the reference fixing temperature Tstd twice is applied to the recording sheet.

(First Modification of the Duplex Printing Processing)

In the first embodiment, in order to minimize occurrence of white dots (electric discharge noise) at the time of duplex printing, the fixing temperatures T1st and T2nd are changed to apply different heat amounts to the first side and the second side of a recording sheet. The present invention is not limited to changing the fixing temperatures. That is, heat amounts applied to a recording sheet at the time of first-side printing and second-side printing may be changed to minimize occurrence of white dots (electric discharge noise) in duplex printing.

Figure 9:
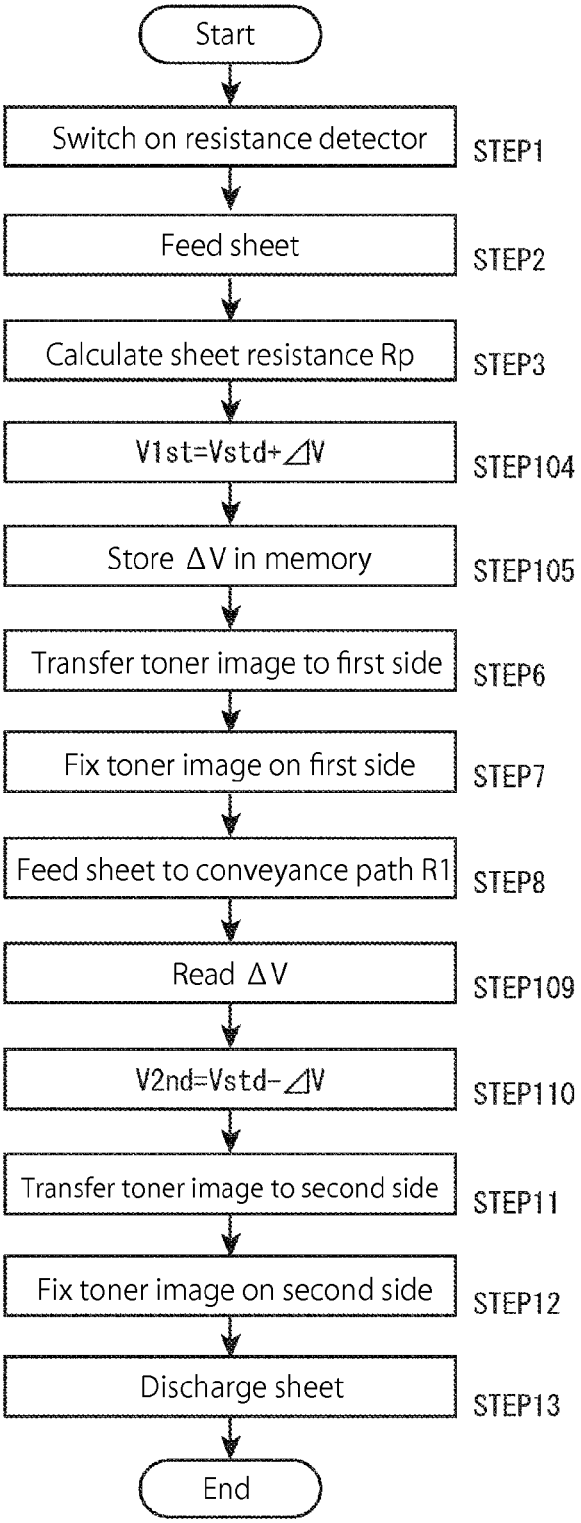
FIG. 9 is a flowchart illustrating a modification of the control operation at the time of duplex printing by the image forming apparatus according to the present invention.

Therefore, in a first modification, there will be taken as an example a control operation in which the conveyance speed (fixing speed) of a recording sheet in the fixing unit 6 is changed for the first-side printing and the second-side printing. The control operation will be described with reference to a flowchart of FIG. 9. In the first modification, although not shown, the controller 108 includes a fixing speed setting section to set a fixing speed as a heat amount setting section in place of the temperature setting section 108. It should be noted that in the flowchart of FIG. 9, the same operation steps as in the flowchart of FIG. 7 are denoted by the same reference numerals, and detailed description of these operation steps will be omitted.

In the first modification, after starting a duplex printing operation and driving the sheet resistance detector 11, the controller 10 makes a recording sheet fed to the main conveyance path R0, and acquires a sheet resistance Rp of the recording sheet (STEP 1 to STEP 3). Based on the sheet resistance Rp, the controller 10 sets a fixing speed V1st of the first-side printing (STEP 104). First, the controller 10 sets a difference (fixing speed change amount) ΔV of the fixing speed V1st of the first-side printing and a fixing speed V2nd of the second-side printing in the duplex printing processing from a reference fixing speed Vstd based on the sheet resistance Rp of the recording sheet notified from the sheet resistance calculator 12. The reference fixing speed Vstd is a fixing speed of simplex printing and serves as a reference value. Then, the controller 10 adds the fixing speed change amount ΔV to the reference fixing speed Vstd, and sets the sum Vstd+ΔV as the fixing speed V1st of the first-side printing.

After setting the fixing speed V1st, the controller 10 temporarily stores the calculated fixing speed change amount ΔV in the RAM 103 (STEP 105). The controller 10 drives the transfer unit 5 and the fixing unit 6 to transfer a toner image on the recording sheet and pass the recording sheet through the fixing unit 6 at the fixing speed V1st. Then, the recording sheet is switched back by the sheet discharge roller pair 71 and conveyed to the circular conveyance path R1 (STEP 6 to STEP 8). Thus, after the toner image is fixed on the first side of the recording sheet, the recording sheet is turned over and conveyed to the main conveyance path R0. In this first-side printing, the fixing speed V1st is made higher than the reference fixing speed Vstd by the fixing speed change amount ΔV. This shortens the time for the recording sheet to pass the fixing unit 6 and decreases the heat amount applied to the recording sheet.

Next, the controller 10 reads the fixing speed change amount ΔV stored in the RAM 103 at STEP 105 (STEP 109), and set a fixing speed V2nd of the second-side printing (STEP 110). At this time, the controller 10 subtracts the fixing speed change amount ΔV from the reference fixing speed Vstd stored in the ROM 102, and sets the difference Vstd−ΔV as the fixing speed V2nd of the second-side printing.

The controller 10 drives the transfer unit 5 and the fixing unit 6 to transfer a toner image to the recording sheet, pass the recording sheet through the fixing unit 6 at the fixing speed V2nd, and discharge the recording sheet to the sheet discharge tray 7 (STEP 11 to STEP 13). At the time of the second-side printing, the fixing speed V2nd is made lower than the reference fixing speed Vstd by the fixing speed change amount ΔV. This lengthens the time for the recording sheet to pass the fixing unit 6 and compensates for insufficiency of the heat amount applied to the recording sheet at the time of the first-side printing.

(Second Modification of the Duplex Printing Processing)

Figure 10:
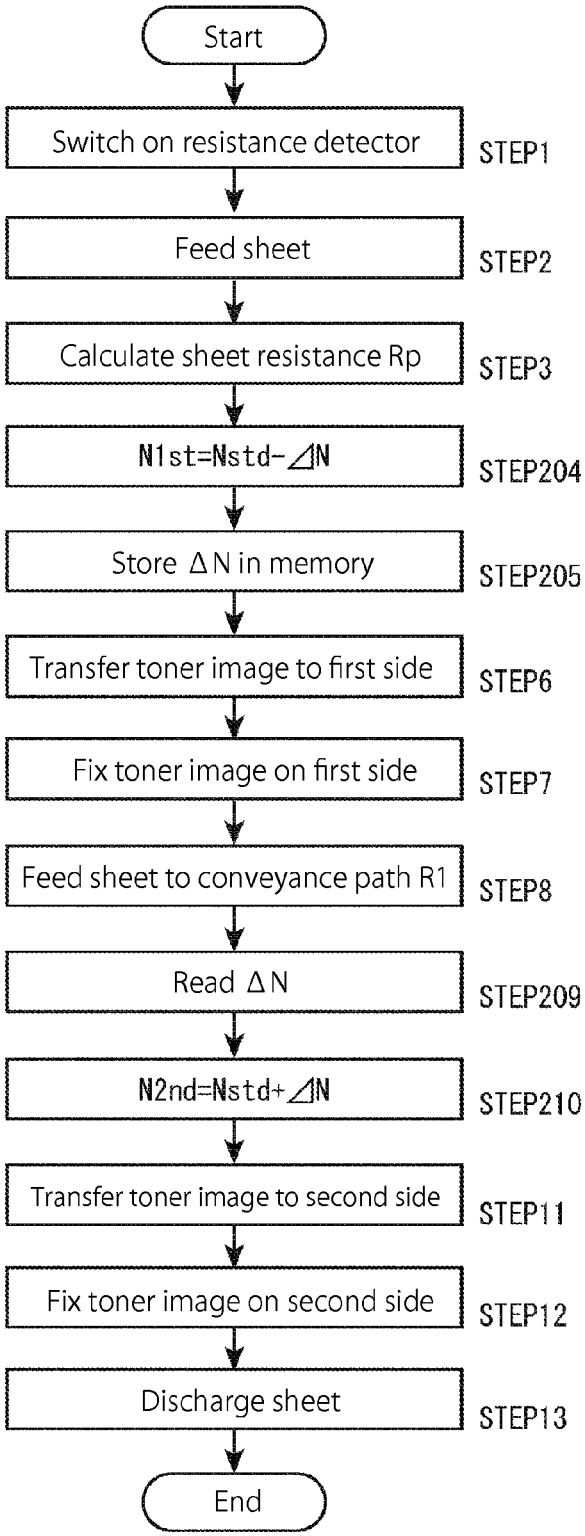
FIG. 10 is a flowchart illustrating a modification of the control operation at the time of duplex printing by the image forming apparatus according to the present invention.

In the above-described first modification, the fixing speeds of the first-side printing and the second-side printing differ from each other. However, in a second modification, there will be taken as an example a control operation in which nip pressures in the fixing unit 6 at the time of the first-side printing and the second-side printing differ from each other. That is, in the second modification, although not shown, the controller 10 includes a nip pressure setting section to set a nip pressure as a heat amount setting section in place of the temperature setting section 108. The control operation at the time of the duplex printing processing in the second modification will be described with reference to a flowchart of FIG. 10. It should be noted that in the flowchart of FIG. 10, the same operation steps as in the flowchart of FIG. 7 are denoted by the same reference numerals, and detailed description of these operation steps will be omitted.

In the second modification, after starting the duplex printing operation, switching on the sheet resistance detector 11, and feeding a recording sheet, the controller 10 acquires a sheet resistance Rp of the recording sheet (STEP 1 to STEP 3). Based on the sheet resistance Rp, the controller 10 sets a fixing nip pressure N1st of the first-side printing (STEP 204). At this time, the controller 10 sets a difference (fixing nip pressure change amount) ΔN of a fixing nip pressure N1st of the first-side printing and a fixing nip pressure N2nd of the second-side printing in the duplex printing from a reference fixing nip pressure Nstd based on the sheet resistance Rp of the recording sheet notified from the sheet resistance calculator 12. The reference fixing nip pressure Nstd is a fixing nip pressure in the simplex printing and serves as a reference value. Then, the controller 10 subtracts the fixing nip pressure change amount ΔN from the reference fixing nip pressure Nstd, and sets the difference Nstd−ΔN as the fixing nip pressure N1st of the first-side printing.

After setting the fixing nip pressure N1st, the controller 10 stores the calculated fixing nip pressure change amount ΔN in the RAM 103 (STEP 205). Then, the transfer unit 5 transfers a toner image to the recording sheet, and the fixing unit 6 pressurizes the recording sheet at the fixing nip pressure N1st to fix the toner image. The recording sheet with the printed first side is conveyed to the circular conveyance path R1 (STEP 6 to STEP 8). In this first-side printing, the fixing nip pressure N1 st is made lower than the reference fixing nip pressure Nstd by the fixing nip pressure change amount ΔN so as to decrease a heat amount applied to the recording sheet.

Next, the controller 10 reads the fixing nip pressure change amount ΔN stored in the RAM 103 at STEP 205 (STEP 209), and sets a fixing nip pressure N2nd of the second-side printing (STEP 210). At this time, the controller 10 adds the fixing nip pressure change amount ΔN to the reference fixing nip pressure Nstd stored in the ROM 102, and sets the sum Nstd+ΔN as the fixing nip pressure N2nd of the second-side printing. Then, the transfer unit 5 transfers a toner image to the recording sheet, and the fixing unit 6 pressurizes the recording sheet at the fixing nip pressure N2nd to fix the toner image. The recording sheet is discharged to the sheet discharge tray 7 (STEP 11 to STEP 13). In this second-side printing, the fixing nip pressure N2nd is made higher than the reference fixing nip pressure Nstd by the fixing nip pressure change amount ΔN so as to compensate for insufficiency of the heat amount applied to the recording sheet in the first-side printing.

Second Embodiment

Figure 11:
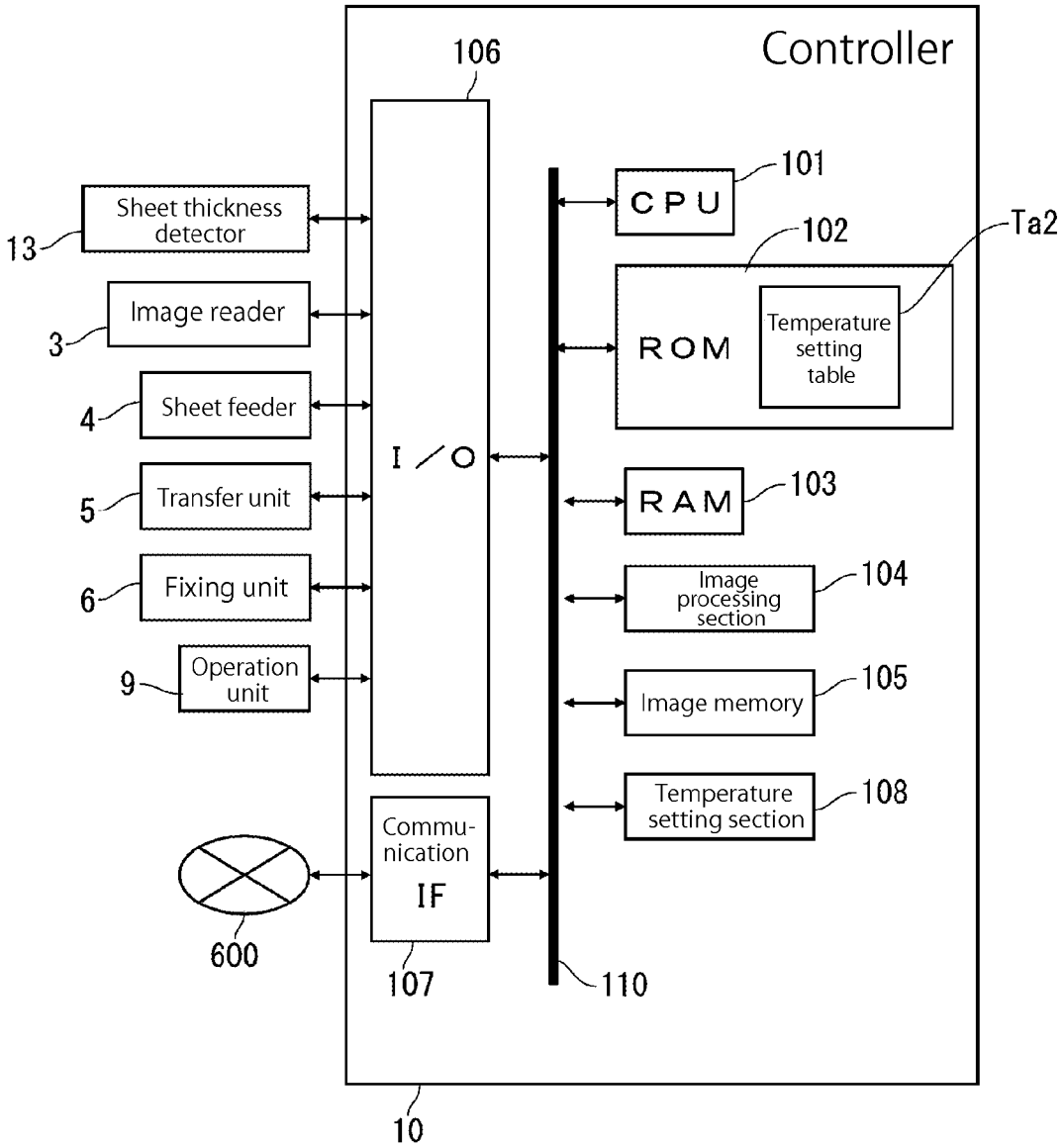
FIG. 11 is a block diagram illustrating a configuration of a controller of an image forming apparatus according to a second embodiment of the present invention.
Figure 13:
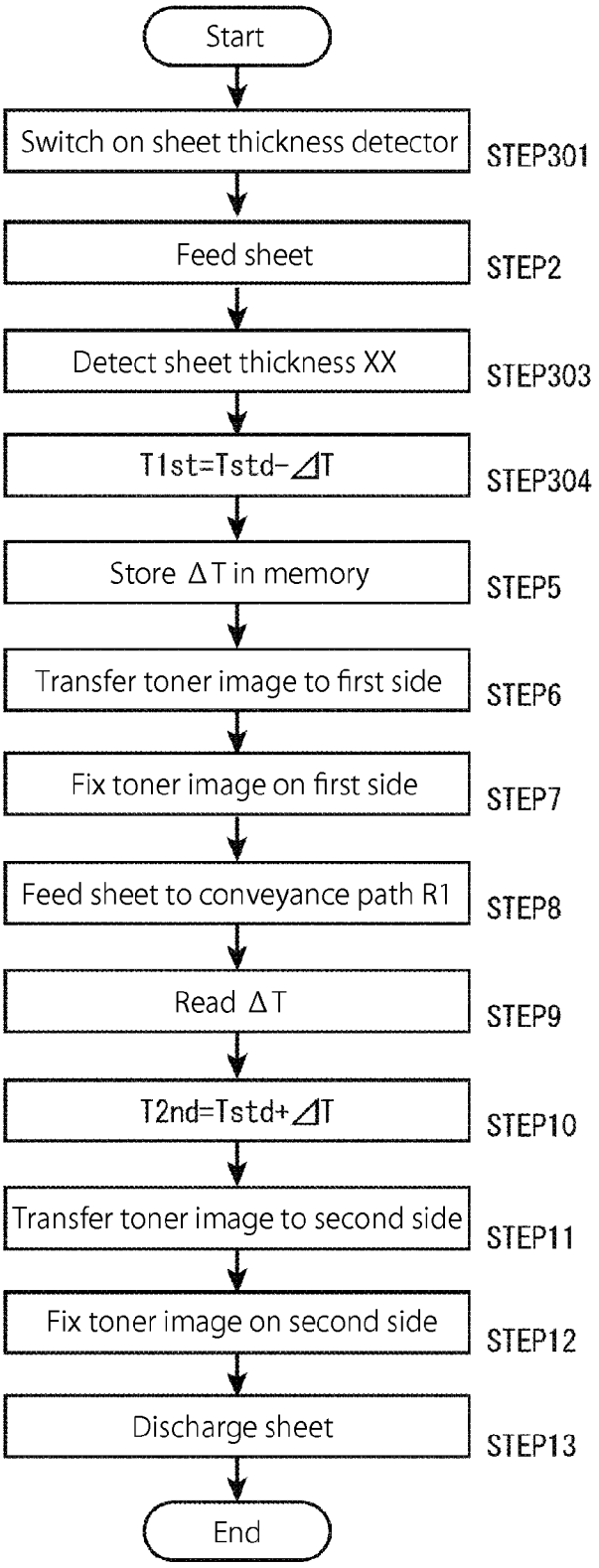
FIG. 13 is a flowchart illustrating a control operation at the time of duplex printing by the image forming apparatus according to the second embodiment of the present invention.

An image forming apparatus according to a second embodiment of the present invention will be described below with reference to the drawings. FIG. 11 is a schematic block diagram illustrating a configuration of a controller of the image forming apparatus according to the second embodiment. FIG. 13 is a flowchart illustrating a control operation at the time of duplex printing. It should be noted that the general arrangement of the image forming apparatus according to the second embodiment includes the above-described configuration shown in FIGS. 1 and 2. In the configuration of FIG. 11, the same components as in the configuration of FIG. 5 are denoted by the same reference numerals. In the flowchart of FIG. 13, the same operation steps as in the flowchart of FIG. 7 are denoted by the same reference numerals, and detailed description of these operation steps will be omitted.

In the image forming apparatus 1 according to the second embodiment, the controller 10 of the configuration shown in FIG. 11 controls the components of the image forming apparatus 1 and executes various kinds of work such as printing of a recording sheet and image reading from a document. The image forming apparatus 1 according to the second embodiment includes a sheet thickness detector 13 to detect a sheet thickness XX of a recording sheet fed to the main conveyance path R0 in place of the sheet resistance detector 11 and the sheet resistance calculator 12 in the configuration of the first embodiment (see FIG. 5). The ROM 102 in the controller 10 stores a temperature setting table Ta2 illustrating a relationship between the sheet thickness XX of a recording sheet and a fixing temperature change amount ΔT in place of the temperature setting table Ta1 in the configuration of the first embodiment (see FIG. 5).

Figure 12:
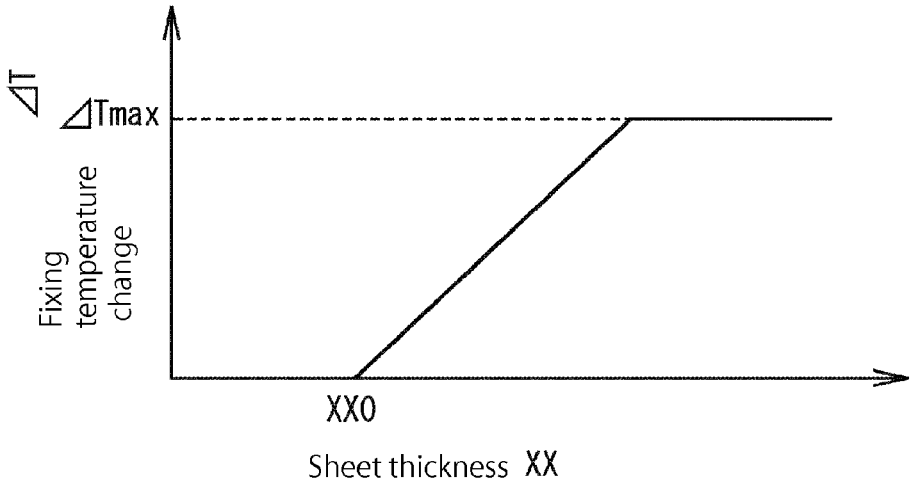
FIG. 12 is a graph illustrating a configuration of a temperature setting table stored in the controller shown in FIG. 11.

The temperature setting table Ta2 stored in the ROM 102 stores the relationship between the sheet thickness XX and the fixing temperature change amount ΔT, which is illustrated in FIG. 12. That is, when duplex printing is performed at the reference fixing temperature Tstd, a value of the sheet thickness XX that causes an unallowable level of white dots at the time of second-side printing is assumed a thickness XX0. As the sheet thickness XX is larger than the value XX0, the fixing temperature change amount ΔT is increased. The maximum value of the fixing temperature change amount ΔT is set at the same value ΔTmax as in the first embodiment.

The sheet thickness detector 13 is disposed between the sheet feeder 4 and the timing roller pair 43, and measures a sheet thickness of a recording sheet until the recording sheet passes a transfer nip area of the transfer unit 5. As the sheet thickness detector 13, there may be employed, for example, a device to directly measure a sheet thickness of a recording sheet using transmitted light or ultrasonic waves or a device to measure a distance of a gap between the timing roller pair 43 to measure the sheet thickness of the recording sheet.

The control operation of duplex printing processing by the controller 10 will now be described with reference to the flowchart shown in FIG. 13. In response to a start instruction of the duplex printing operation, the controller 10 drives the sheet thickness detector 13 to measure a sheet thickness of a recording sheet fed to the main conveyance path R0 (STEP 301). Then, the controller 10 feeds the recording sheet from the sheet feeder 4 to the main conveyance path R0 (STEP 2). Thus, until the recording sheet fed to the main conveyance path R0 reaches the timing roller pair 43, the sheet thickness detector 13 detects a sheet thickness XX of the recording sheet, and notifies the controller 10 of a measurement result (STEP 303). The input/output interface 106 receives the sheet thickness XX of the recording sheet, and the controller 10 gives the sheet thickness XX to the temperature setting section 108.

Referring to the temperature setting table Ta2 in the ROM 102, the temperature setting section 108 acquires a fixing temperature change amount ΔT based on the sheet thickness XX. The fixing temperature change amount ΔT is subtracted from the reference fixing temperature Tstd, and the difference Tstd−ΔT is set as a fixing temperature T1st of the first-side printing (STEP 304). That is, the controller 10 determines that as the sheet thickness XX of the recording sheet increases, the sheet resistance of the recording sheet increases, and sets that the fixing temperature change amount ΔT is to increase, thus calculating the fixing temperature T1st. The controller 10 notifies the fixing unit 6 of the set fixing temperature T1st, and temporarily stores the fixing temperature change amount ΔT in the RAM 103 (STEP 5).

Next, similarly to the first embodiment, after printing the first side of the recording sheet based on the fixing temperature T1st, the recording sheet turned over is conveyed through the circular conveyance path R1 to the main conveyance path R0 (STEP 6 to STEP 8). When printing of the second side of the recording sheet is started, the controller 10 reads the fixing temperature change amount ΔT in the RAM 103, and sets a temperature Tstd+ΔT as a fixing temperature T2nd of the second-side printing. After printing the second side of the recording sheet based on the fixing temperature T2nd, the recording sheet both sides of which are printed is discharged to the sheet discharge tray 7 (STEP 9 to STEP 13).

Third Embodiment

Figure 14:
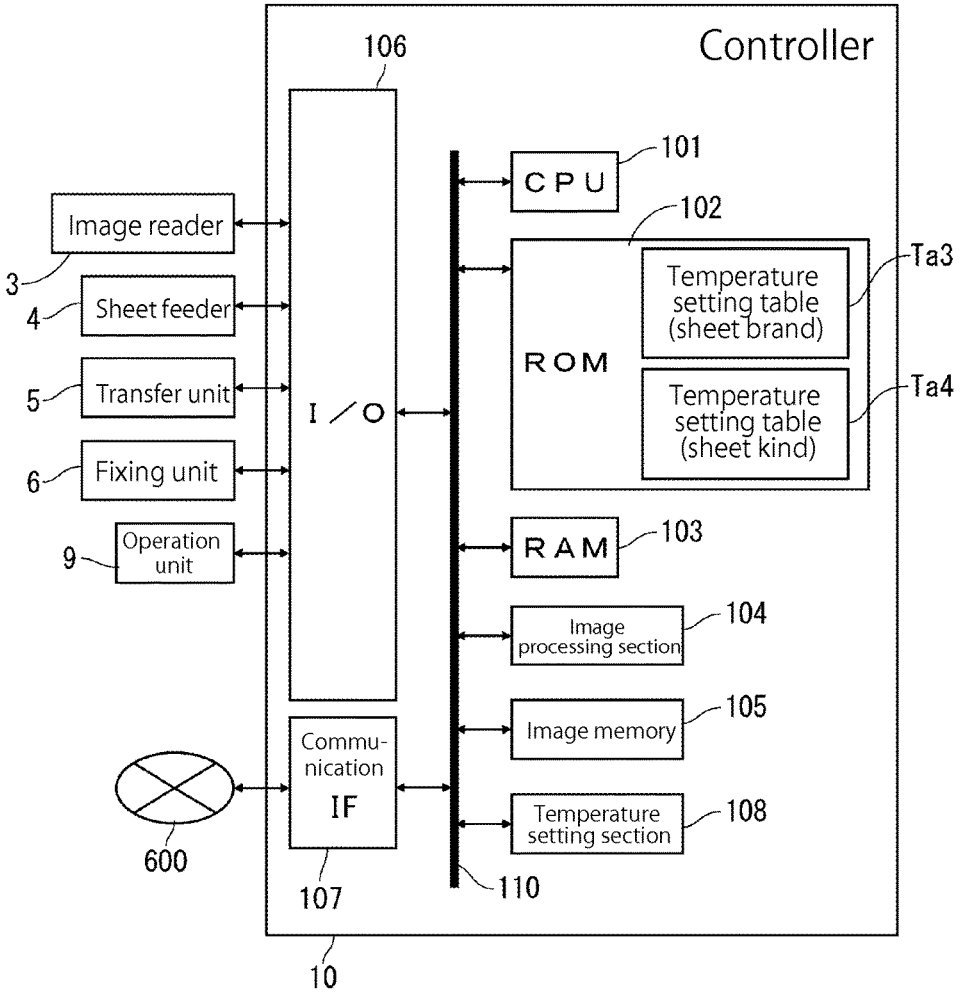
FIG. 14 is a block diagram illustrating a configuration of a controller of an image forming apparatus according to a third embodiment of the present invention.
Figure 16:
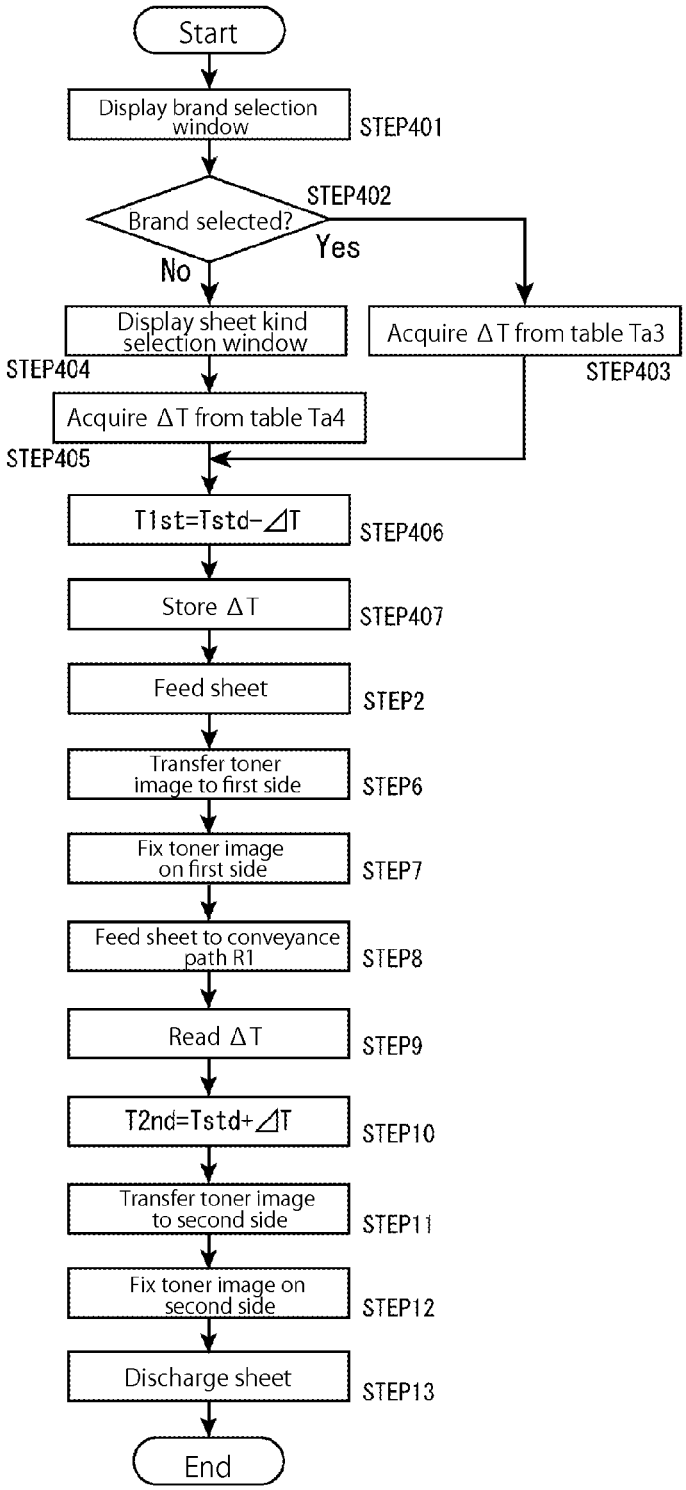
FIG. 16 is a flowchart illustrating a control operation at the time of duplex printing by the image forming apparatus according to the third embodiment of the present invention.

An image forming apparatus according to a third embodiment of the present invention will be described below with reference to the drawings. FIG. 14 is a schematic block diagram illustrating a configuration of a controller of the image forming apparatus according to the third embodiment. FIG. 16 is a flowchart illustrating a control operation at the time of duplex printing. It should be noted that the general arrangement of the image forming apparatus according to the third embodiment includes the configuration shown in FIGS. 1 and 2. In the configuration shown in FIG. 14, the same components as in the configuration shown in FIG. 5 are denoted by the same reference numerals. In the flowchart shown in FIG. 16, the same operation steps as in the flowchart of FIG. 7 are denoted by the same reference numerals, and detail description of these operation steps is omitted.

In the image forming apparatus 1 according to the third embodiment, the controller 10 of the configuration shown in FIG. 14 controls the components of the image forming apparatus 1 and executes various kinds of work such as printing of a recording sheet and image reading from a document. The image forming apparatus 1 according to the third embodiment has the configuration of the first embodiment (see FIG. 5) from which the sheet resistance detector 11 and the sheet resistance calculator 12 are eliminated. In place of the temperature setting table Ta1 in the configuration of the first embodiment (see FIG. 5), the ROM 12 in the controller 10 stores a temperature setting table Ta3 indicating a relationship between a sheet brand of a recording sheet and a fixing temperature change amount ΔT, and a temperature setting table Ta4 indicating a relationship between a sheet kind of a recording sheet and the fixing temperature change amount ΔT.

Figure 15:
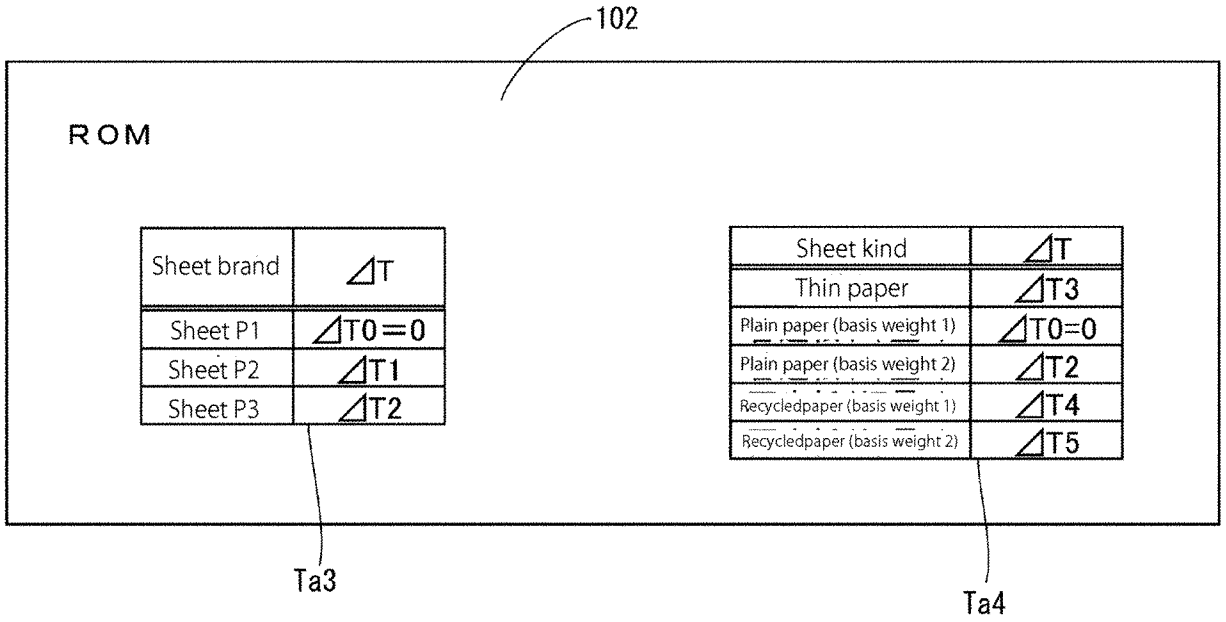
FIG. 15 is a schematic diagram illustrating a configuration of a temperature setting table stored in the controller shown in FIG. 14.

The temperature setting table Ta3 stores fixing temperature change amounts ΔT with respect to sheet brands frequently used. In order to set the fixing temperature change amounts ΔT with respect to sheet brands that are not stored in the fixing temperature table Ta3, the temperature setting table Ta4 stores fixing temperature change amounts ΔT with respect to sheet kinds. As shown in FIG. 15, for example, the fixing temperature table Ta3 stores values ΔT0 to ΔT2 ($\Delta T0=0<\Delta T1<\Delta T2<\Delta Tmax$) as the fixing temperature change amounts ΔT respectively corresponding to sheet brands P1 to P3. That is, since a relationship of sheet resistances Rpt to Rp3 of the sheet brands P1 to P3 is Rpt<Rp0<Rp2<Rp3, the fixing temperature change amounts ΔT respectively corresponding to the sheet brands P1 to P3 are the values ΔT0 to ΔT2.

As shown in FIG. 15, for example, the temperature setting table Ta4 stores fixing temperature change amounts ΔT corresponding to five sheet kinds "thin paper", "plain paper A", "plain paper B (having a basis weight twice as large as plain paper A)", "recycled paper X", and "recycled paper Y (having a basis weight twice as large as recycled paper X)". Here, the sheet resistances are "plain paper A"<"plain paper B"<"thin paper"<"recycled paper X"<"recycled paper Y". If a sheet resistance of plain paper A is assumed smaller than Rp0, the temperature setting table Ta4 stores values ΔT0, ΔT2, ΔT3, ΔT4, and ΔT5 (ΔT0=0<ΔT2<ΔT3<ΔT4<ΔT5<ΔTmax) respectively corresponding to the sheet kinds "plain paper A", "plain paper B", "thin paper", "recycled paper X", and "recycled paper Y".

The control operation of duplex printing by the controller 10 will be described below with reference to the flowchart shown in FIG. 16. The image forming apparatus 1 according to the third embodiment is different from the first and second embodiments in that the user specifies a sheet brand or a sheet kind. Consequently, a fixing temperature change amount ΔT corresponding to a recording sheet to be printed is set to perform the duplex printing processing.

In response to a start instruction of the duplex printing operation, the controller 10 displays an image (brand selection window) in the operation panel (operation unit) 9 so as to select a sheet brand of a recording sheet to be printed, and receives a selection by the user (STEP 401). When receiving the operation of the operation panel 9 by the user, the controller 10 confirms whether the sheet brand of the recording sheet is selected (STEP 402). If the selected sheet brand is notified from the operation panel 9, (Yes at STEP 402), the temperature setting section 108 refers to the temperature setting table Ta3 of the ROM 102, and acquires a fixing temperature change amount ΔT corresponding to the notified sheet brand (STEP 403).

If it is notified from the operation panel 9 that the sheet brand is not selected (No at STEP 402), the controller 10 transmits a display command of a sheet kind selection window to the operation panel 9 (STEP 404). Thus, the operation panel 9 displays an image to select a sheet kind of the recording sheet to be printed (sheet kind selection window) and receives a selection by the user. In response to the operation of the operation panel 9 by the user to select the sheet kind of the recording sheet, the operation panel 9 notifies the controller 10 of the selected sheet kind. Then, the temperature setting section 108 refers to the temperature setting table Ta4 of the ROM 102 and acquires a fixing temperature change amount ΔT corresponding to the selected sheet kind (STEP 405).

When the temperature setting section 108 acquires a fixing temperature change amount ΔT at each of STEP 403 and STEP 405, the temperature setting section 108 subtracts the acquired fixing temperature change amount ΔT from the reference fixing temperature Tstd, and sets the difference Tstd−ΔT as a fixing temperature T1st of the first-side printing (STEP 406). Then, the controller 10 notifies the fixing unit 6 of the set fixing temperature T1st, and temporarily stores the fixing temperature change amount ΔT in the RAM 103 (STEP 407).

Next, when the controller 10 makes the sheet feeder 4 feed the recording sheet to the main conveyance path R0 (STEP 2), the first side of the recording sheet is printed based on the fixing temperature T1st, and the recording sheet turned over is conveyed through the circular conveyance path R1 to the main conveyance path R0 (STEP 6 to STEP 8). Thus, printing of the second side of the recording sheet is started. Similarly to the first embodiment, the controller 10 reads the fixing temperature change amount ΔT from the RAM 103 and sets a temperature Tstd+ΔT as a fixing temperature T2nd of the second-side printing. Based on the fixing temperature T2nd, the second side of the recording sheet is printed, and the recording sheet both sides of which are printed is discharged to the sheet discharge tray 7 (STEP 9 to STEP 13).

It should be noted that in the third embodiment, the feed operation of the recording sheet is performed after setting the fixing temperature T1st of the first-side printing. However, insofar as the fixing temperature T1st of the first-side printing is set before the recording sheet reaches the timing roller pair 43, the feed operation of the recording sheet may be performed before setting the fixing temperature T1st of the first-side printing. Moreover, when receiving a selection of the sheet brand of the recording sheet by the user, the controller 10 identifies the sheet brand of the recording sheet. However, for example, sheet brands or sheet kinds of recording sheets contained in the respective sheet feeders 4 may be stored in the RAM 103 in advance. When an instruction of the duplex printing operation is received, one of the sheet feeders 4 is selected for a feed operation so as to specify a sheet brand or a sheet kind.

Fourth Embodiment

Figure 17:
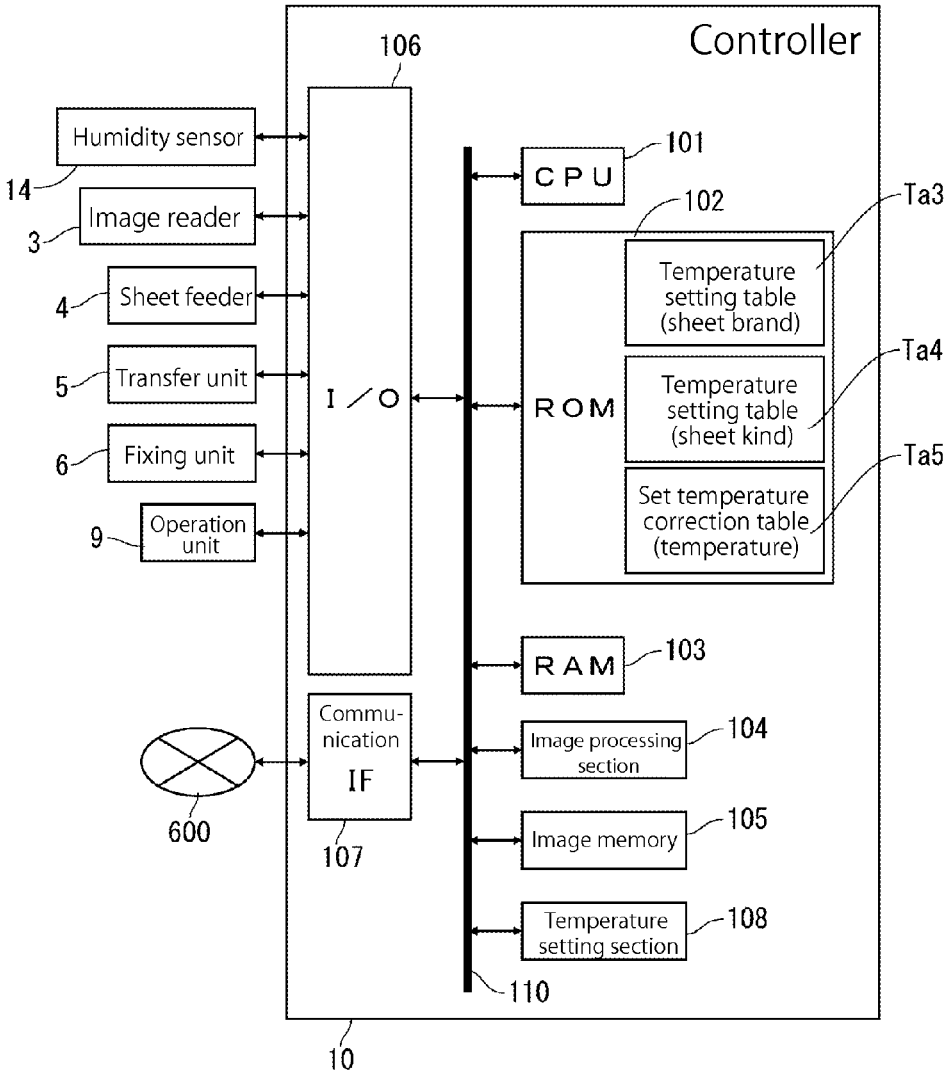
FIG. 17 is a block diagram illustrating a configuration of a controller of an image forming apparatus according to a fourth embodiment of the present invention.
Figure 19:
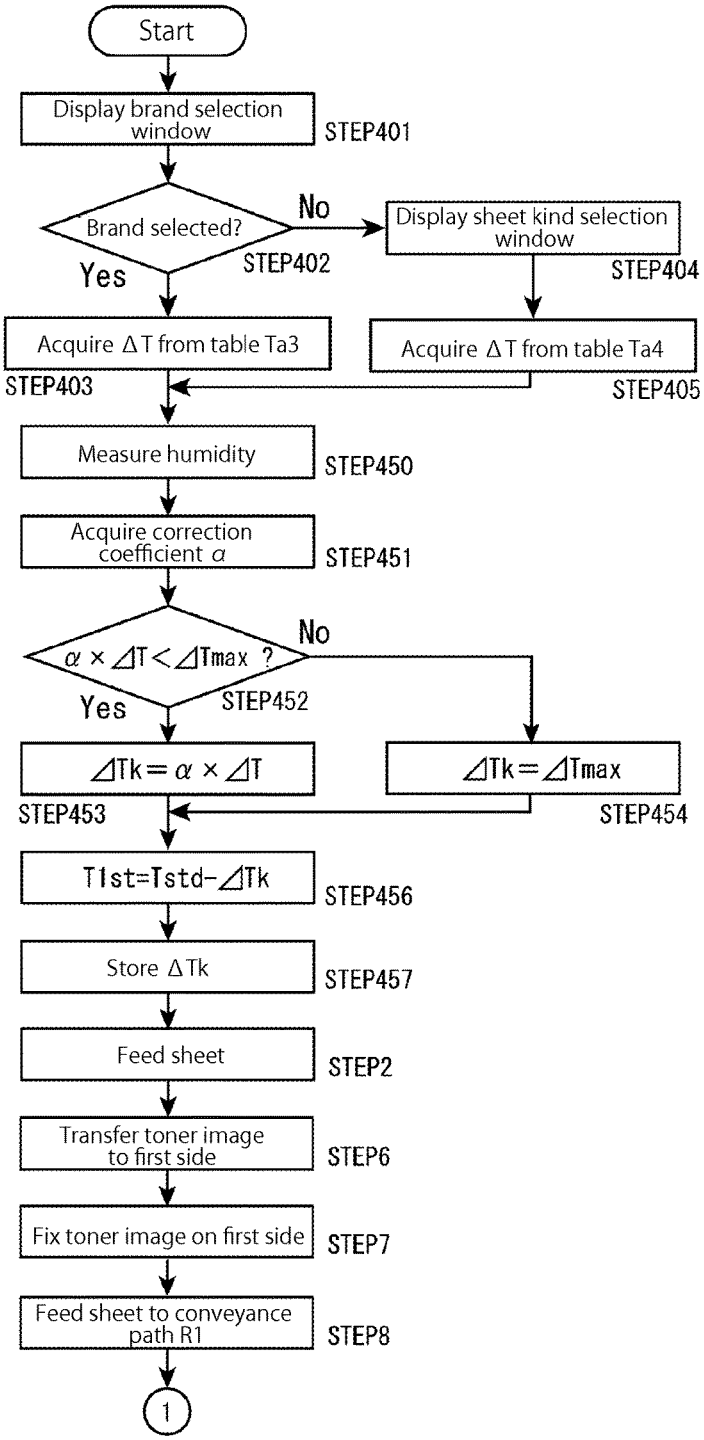
FIG. 19 is a flowchart illustrating part of a control operation at the time of duplex printing by the image forming apparatus according to the fourth embodiment of the present invention.
Figure 20:
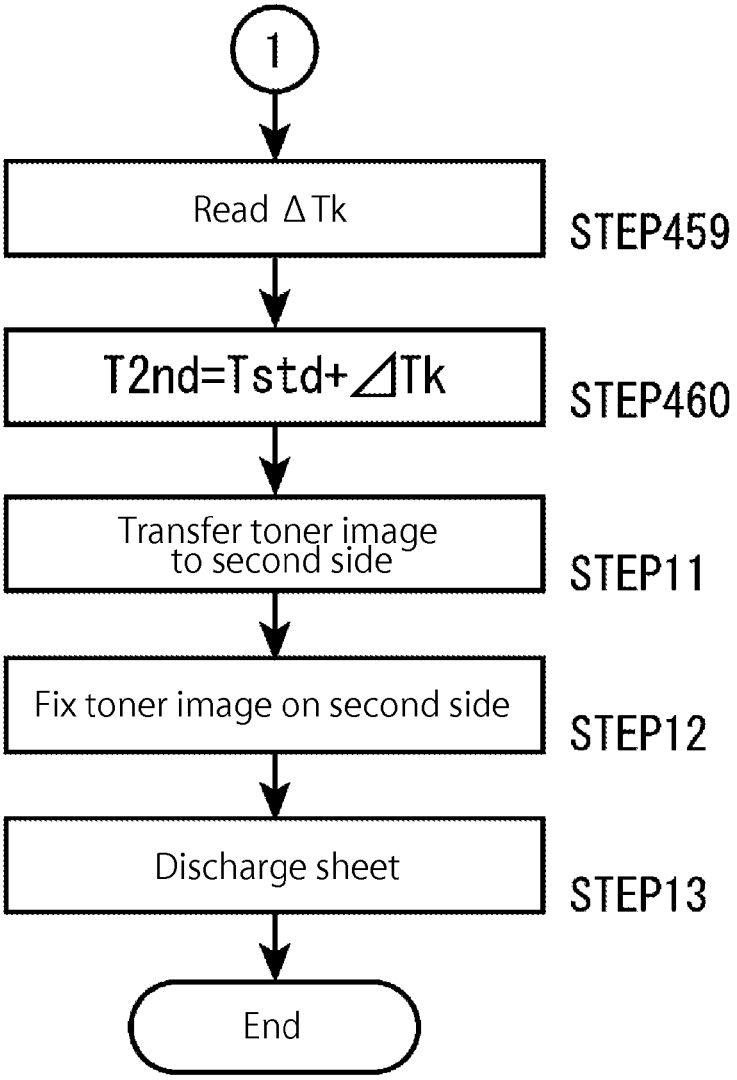
FIG. 20 is a flowchart illustrating part of a control operation at the time of duplex printing by the image forming apparatus according to the fourth embodiment of the present invention.

An image forming apparatus according to a fourth embodiment of the present invention will be described below with reference to the drawings. FIG. 17 is a schematic block diagram illustrating a configuration of a controller of the image forming apparatus according to the fourth embodiment. FIGS. 19 and 20 are flowcharts illustrating a control operation at the time of duplex printing. It should be noted that the general arrangement of the image forming apparatus according to the fourth embodiment includes the configuration shown in FIGS. 1 and 2. In the configuration shown in FIG. 17, the same components as in the configuration shown in FIG. 14 are denoted by the same reference numerals. In the flowcharts shown in FIGS. 19 and 20, the same operation steps as in the flowchart of FIG. 16 are denoted by the same reference numerals, and detail description of these operation steps is omitted.

In the image forming apparatus 1 according to the fourth embodiment, the controller 10 of the configuration shown in FIG. 17 controls the components of the image forming apparatus 1 and executes various kinds of work such as printing of a recording sheet and image reading from a document. The image forming apparatus 1 according to the fourth embodiment has the configuration of the third embodiment (see FIG. 14) to which a humidity sensor 14 to detect a humidity inside of the apparatus main body 2 is added. In addition to the temperature setting tables Ta3 and Ta4, the ROM 102 in the controller 10 stores a set temperature correction table Ta5 for correcting a fixing temperature change amount ΔT based on a humidity measured by the humidity sensor 14.

A humidity correction coefficient α read from the set temperature correction table Ta5 is set in such a manner that the humidity correction coefficient α has a larger value when the humidity inside of the apparatus main body 2 measured by the humidity sensor 14 is lower. That is, when the humidity inside of the apparatus main body 2 is low, a sheet resistance Rp of a recording sheet is high. When the humidity inside of the apparatus main body 2 is high, the sheet resistance Rp of the recording sheet is low. Therefore, a relative humidity with respect to a humidity when a recording sheet is in a sealed state as a reference is output from the humidity sensor 14, and the temperature setting section 108 acquires the relative humidity. Referring to the set temperature correction table Ta5, a humidity correction coefficient α corresponding to the acquired relative humidity is set.

Figure 18:
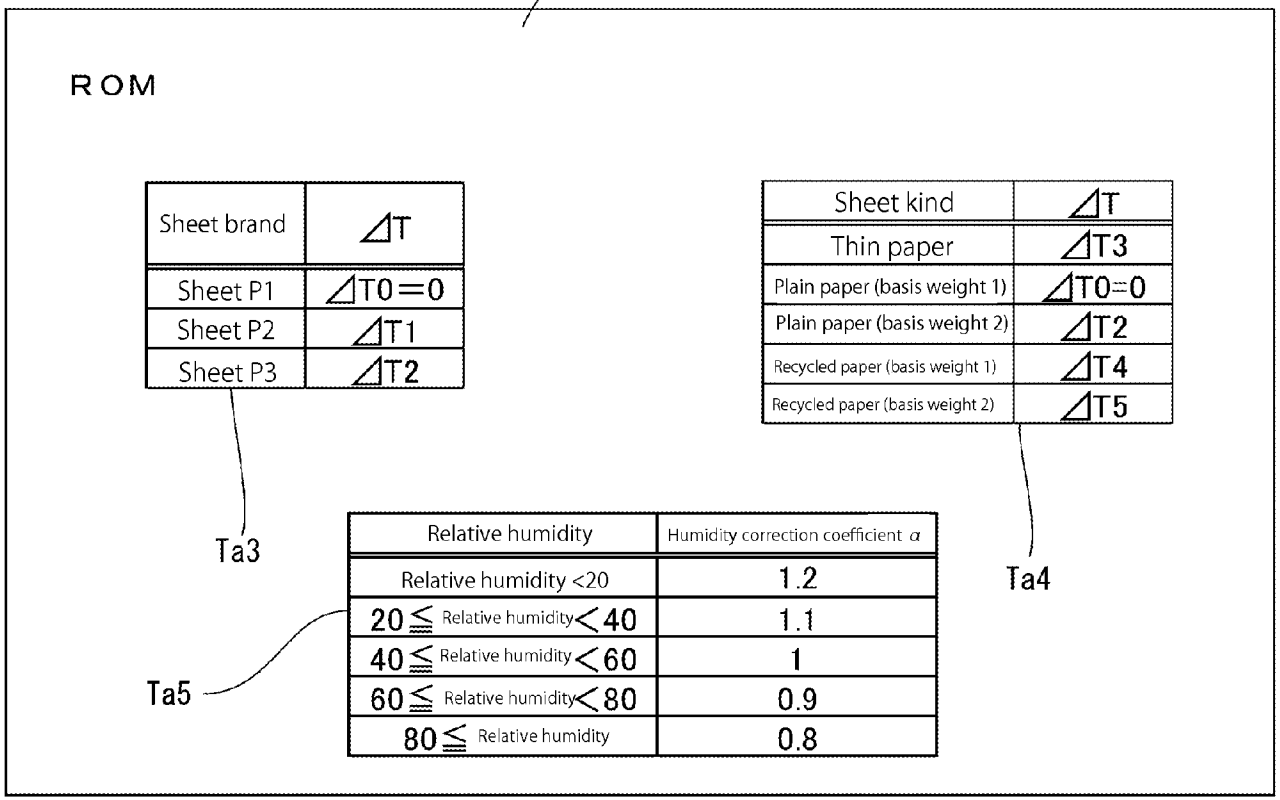
FIG. 18 is a schematic diagram illustrating a configuration of a temperature setting table stored in the controller shown in FIG. 17.

In the set temperature correction table Ta5, as shown in FIG. 18, for example, when the relative humidity is lower than 20%, the correction coefficient α is "1.2". When the relative humidity is equal to or higher than 20% and lower than 40%, the correction coefficient α is "1.1". When the relative humidity is equal to or higher than 40% and lower than 60%, the correction coefficient α is "1.0". When the relative humidity is equal to or higher than 60% and lower than 80%, the correction coefficient α is "0.9". When the relative humidity is equal to or higher than 80%, the correction coefficient α is "0.8".

The control operation of the duplex printing processing by the controller 10 will be described below with reference to the flowcharts shown in FIGS. 19 and 20. Similarly to the third embodiment, when receiving a start instruction of a duplex printing operation, the controller 10 refers to one of the temperature setting tables Ta3 and Ta4. Based on a sheet brand or a sheet kind selected by operating the operation panel 9, the controller 10 sets a fixing temperature change amount ΔT (STEP 401 to STEP 405). Then, the controller 10 acquires a humidity inside of the apparatus main body 2 measured by the humidity sensor 14 and calculates a relative humidity (STEP 450). The temperature setting section 108 refers to the set temperature correction table Ta5, and acquires a correction coefficient α corresponding to the relative humidity (STEP 451).

The temperature setting section 108 multiplies the correction coefficient α acquired at STEP 451 by the fixing temperature change amount ΔT set at STEP 403 or STEP 405, and determines whether the product α×ΔT is smaller than the maximum value ΔTmax (see FIG. 6) (STEP 452). At this time, if the value α×ΔT is smaller than the maximum value ΔTmax (Yes at STEP 452), the temperature setting section 108 regards the value α×ΔT as a fixing temperature change amount ΔTk after humidity correction (STEP 453). If the value α×ΔT is equal to or larger than the maximum value ΔTmax (No at STEP 452), the temperature setting section 108 regards the maximum value ΔTmax as the fixing temperature change amount ΔTk after humidity correction (STEP 454).

Next, the temperature setting section 108 subtracts the fixing temperature change amount ΔTk acquired at STEP 454 from the reference fixing temperature Tstd, and sets the temperature Tstd−ΔTk as a fixing temperature T1st of the first-side printing (STEP 456). The controller 10 notifies the fixing unit 6 of the set fixing temperature T1st, and temporarily stores the fixing temperature change amount ΔTk in the RAM 103 (STEP 457). Then, the controller 10 makes the sheet feeder 4 to feed a recording sheet to the main conveyance path R0 (STEP 2). Based on the fixing temperature T1st, the first side of the recording sheet is printed, and the recording sheet turned over is conveyed through the circular conveyance path R1 to the main conveyance path R0 (STEP 6 to STEP 8).

After the recording sheet is turned over at STEP 8, printing of the second side of the recording sheet is started. The temperature setting section 108 reads the fixing temperature change amount ΔTk from the RAM 103 (STEP 459). The temperature setting section 108 adds the fixing temperature change amount ΔTk to the reference fixing temperature Tstd read from the ROM 102, and sets the temperature Tstd+ΔTk as a fixing temperature T2nd of the second-side printing (STEP 460). Then, based on the fixing temperature T2nd, the controller 10 performs printing of the second side of the recording sheet, and discharges the recording sheet after duplex printing to the sheet discharge tray 7 (STEP 11 to STEP 13).

Fifth Embodiment

Figure 21:
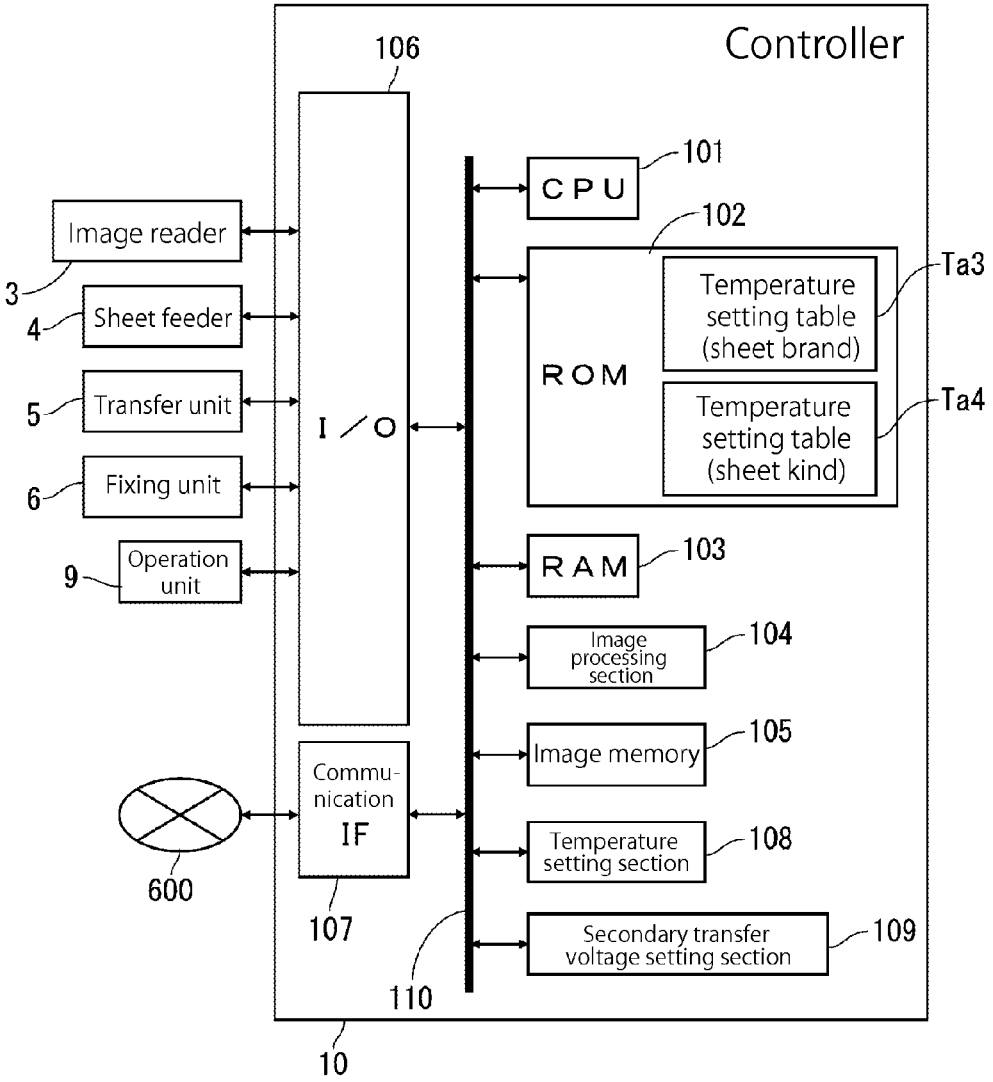
FIG. 21 is a block diagram illustrating a configuration of a controller of an image forming apparatus according to a fifth embodiment of the present invention.
Figure 22:
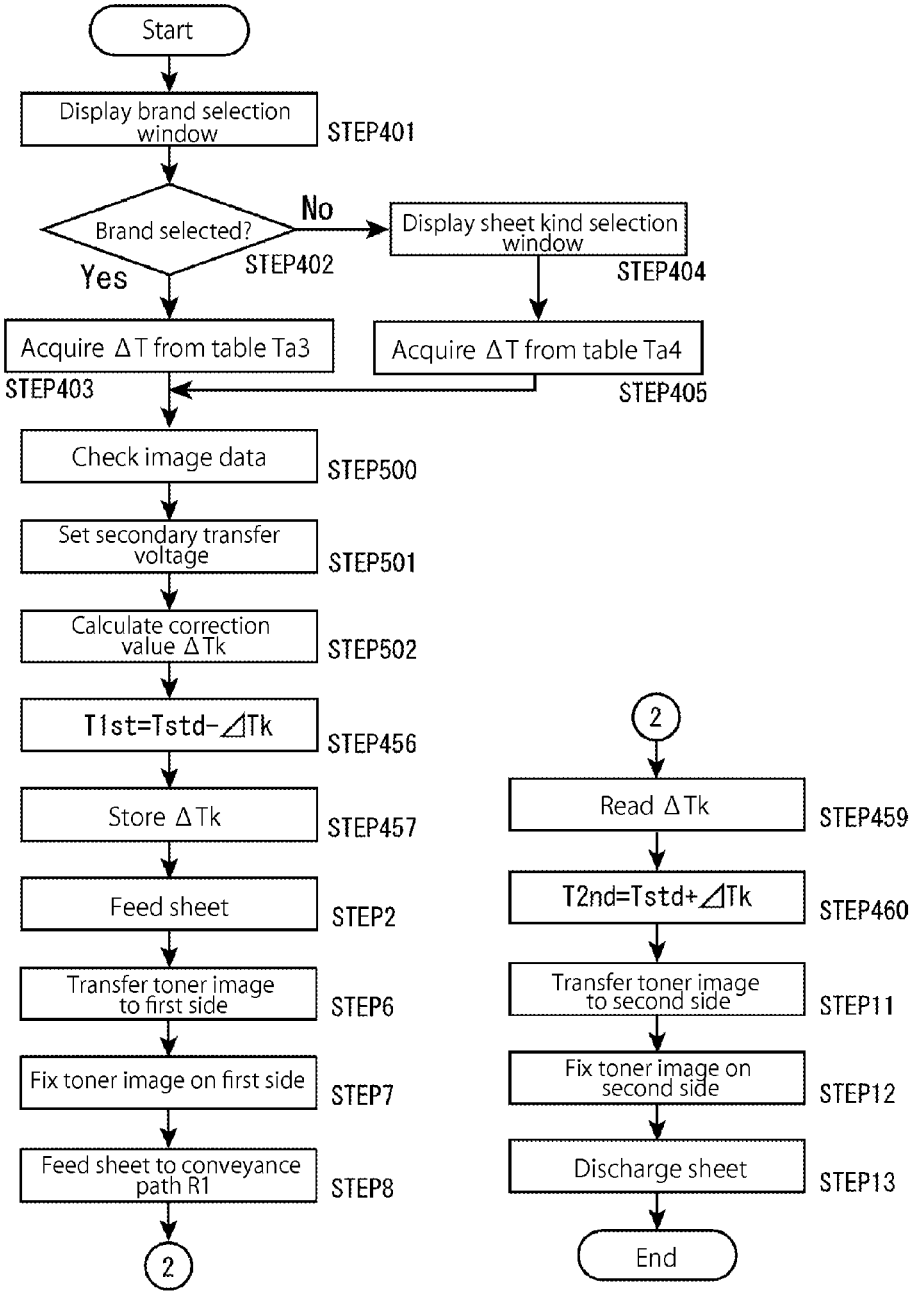
FIG. 22 is a flowchart illustrating a control operation at the time of duplex printing by the image forming apparatus according to the fifth embodiment of the present invention.

An image forming apparatus according to a fifth embodiment of the present invention will be described below with reference to the drawings. FIG. 21 is a schematic block diagram illustrating a configuration of a controller of the image forming apparatus according to the fifth embodiment. FIG. 22 is a flowchart illustrating a control operation at the time of duplex printing. It should be noted that the general arrangement of the image forming apparatus according to the fifth embodiment includes the configuration shown in FIGS. 1 and 2. In the configuration shown in FIG. 21, the same components as in the configuration shown in FIG. 14 are denoted by the same reference numerals. In the flowchart shown in FIG. 22, the same operation steps as in the flowchart of FIG. 16 are denoted by the same reference numerals, and detail description of these operation steps is omitted.

In the image forming apparatus 1 according to the fifth embodiment, the controller 10 of the configuration shown in FIG. 21 controls the components of the image forming apparatus 1 and executes various kinds of work such as printing of a recording sheet and image reading from a document. The controller 10 has the configuration of the third embodiment (see FIG. 14) to which a secondary transfer voltage setting section 109 to set a secondary transfer voltage applied to the secondary transfer roller 57 is added. The image forming apparatus 1 according to the fifth embodiment is different from the third embodiment as follows. In the duplex printing processing, a fixing temperature change amount ΔT is corrected based on a value of the secondary transfer voltage applied to the secondary transfer roller 57, and a fixing temperature is set based on the corrected fixing temperature change amount ΔTk. Therefore, regarding a control operation of the duplex printing processing by the controller 10, correction of the fixing temperature change amount will be mainly described with reference to the flowchart shown in FIG. 22.

Similarly to the third embodiment, when the controller 10 receives a start instruction of the duplex printing operation, the fixing temperature setting section 108 sets a fixing temperature change amount ΔT based on a sheet brand or a sheet kind selected by operating the operation panel 9 (STEP 401 to STEP 405). Then, the secondary transfer voltage setting section 109 checks image data to be printed from the image memory 105 (STEP 500), and sets a secondary transfer voltage applied to the secondary transfer roller 57 (STEP 501). Based on the secondary transfer voltage set in the secondary transfer voltage setting section 109, the temperature setting section 108 corrects the fixing temperature change amount ΔT and calculates a corrected fixing temperature change amount ΔTk (STEP 502).

At STEP 501, based on the sheet brand or the sheet kind set at STEP 401 to STEP 405, the secondary transfer voltage setting section 109 first identifies the sheet resistance Rp to set a secondary transfer voltage as a reference (reference transfer voltage). This reference transfer voltage is set to have a larger absolute value as the sheet resistance Rp of the recording sheet increases, for example. Setting the reference transfer voltage, the secondary transfer voltage setting section 109 calculates toner amounts of first-side printing and second-side printing based on the first-side and second-side image data checked at STEP 500.

Based on the toner amount of the first-side printing, the secondary transfer voltage setting section 109 acquires a printing image area (image coverage) of the second-side printing. Based on the printing image area (size), the secondary transfer voltage setting section 109 corrects the reference transfer voltage and calculates a first corrected transfer voltage for the second-side printing. Then, based on the toner amount of the second-side printing, a toner electrification amount by transfer toner at the time of the second-side printing is acquired. Based on the toner electrification amount of the second-side printing, the first corrected transfer voltage is further corrected to calculate a second corrected transfer voltage for the second-side printing. It should be noted that after the secondary transfer voltage setting section 109 calculates the first corrected transfer voltage based on the toner electrification amount of the second-side printing, the second corrected transfer voltage may be calculated based on the printing image area (image coverage) of the second-side printing.

At STEP 502, based on one of the reference transfer voltage, the first corrected transfer voltage, and the second corrected transfer voltage set at the secondary transfer voltage setting section 109, the temperature setting section 108 corrects the fixing temperature change amount ΔT and calculates a corrected fixing temperature change amount ΔTk. At this time, the fixing temperature change amount ΔT is corrected to have a larger value as the absolute value of the transfer voltage set at the secondary transfer voltage setting section 109 increases. Thus, the corrected fixing temperature change amount ΔTk is calculated. It should be noted that when the calculated correction value exceeds the maximum value ΔTmax, the corrected fixing temperature change amount ΔTk is set to the maximum value ΔTmax.

When the temperature setting section 108 calculates the corrected fixing temperature change amount ΔTk at STEP 502, the temperature setting section 108 sets a fixing temperature T1st of the first-side printing, similarly to the fourth embodiment, and temporarily stores the fixing temperature change amount ΔTk in the RAM 103 (STEP 456 and STEP 457). The controller 10 makes the sheet feeder 4 to feed a recording sheet (STEP 2). Based on the fixing temperature T1st, the first side of the recording sheet is printed, and the recording sheet is turned over and conveyed to the main conveyance path R0 (STEP 6 to STEP 8). Then, the temperature setting section 108 reads the fixing temperature change amount ΔTk from the RAM 103 and sets a fixing temperature T2nd for the second-side printing (STEP 459 and STEP 460). After the second side of the recording sheet is printed based on the fixing temperature T2nd, the controller 10 discharges the recording sheet after duplex printing to the sheet discharge tray 7 (STEP 11 to STEP 13).

In this configuration, the temperature setting section 108 sets the fixing temperature change amount ΔTk to have a larger value as the absolute value of the secondary transfer voltage increases. When the toner electrification amount is regarded as a condition, the temperature setting section 108 sets the fixing temperature change amount ΔTk to have a larger value as the toner amount to be transferred to the recording sheet increases. When the printing image area in the recording sheet is regarded as a condition, the temperature setting section 108 sets the fixing temperature change amount ΔTk to have a larger value as the printing image area to the recording sheet increases.

It should be noted that the fourth and fifth embodiments have the similar configurations to the third embodiment in which correction is executed after referring to the temperature setting tables Ta3 and Ta4 and setting the fixing temperature change amount ΔT. However, the fourth and fifth embodiments may have the similar configurations to the first and second embodiments. Specifically, after referring to the temperature setting tables Ta3 and Ta4, and setting the fixing temperature change amount ΔT based on the measured sheet resistance Rp or the measured sheet thickness XX, correction may be executed based on the humidity inside of the apparatus main body 2 or the secondary transfer voltage. Moreover, in the second to fifth embodiments, as in the first and second modifications of the duplex printing processing in the first embodiment, the conveyance speed (fixing speed) of the recording sheet at the fixing unit 6 or the nip pressure at the fixing unit 6 may be changed to have different values at the time of first-side printing and second-side printing.

Furthermore, the image forming apparatus according to the present invention may be a multifunction peripheral (MFP) having a copy function, a scanner function, a printer function, and a fax function. The image forming apparatus may be a printer or a copying machine or a facsimile. In addition, the configurations of the components are not limited to the embodiments shown in the drawings, and may be modified in various manners within the scope of the subject matter of the present invention.

With the image forming apparatus according to the embodiment of the present invention, In the duplex printing, the heat amount for the first-side printing is smaller than the heat amount for the simplex printing, and the heat amount for the second-side printing is larger than the heat amount for the simplex printing. This suppresses a decrease of the moisture content of the recording sheet at the time of the second-side printing in order to prevent generation of electric discharge noise (white dots) at the time of the second-side printing and to prevent defective fixing after duplex printing due to an insufficient heat amount. Also, optimization is executed to make the sum of the heat amounts for the first-side printing and the second-side printing approximately twice as large as the heat amount for the simplex printing. This provides a heat amount required for fixing at the time of duplex printing, and at the same time suppresses the power consumption to contribute to energy saving.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus configured to perform simplex printing for printing a first side of a recording sheet and to perform duplex printing for printing the first side and a second side of the recording sheet, the image forming apparatus comprising:

an image carrier configured to carry a toner image;

a transfer unit configured to transfer the toner image on the image carrier to a recording sheet;

a fixing unit configured to fix the toner image, which has been transferred at the transfer unit, on the recording sheet;

a sheet discharge tray to which the recording sheet on which the image is formed is discharged;

a circular conveyance path configured to turn over the recording sheet that has been passed through the transfer unit and the fixing unit and to pass the recording sheet through the transfer unit and the fixing unit again; and a heat amount setting section configured to set an amount of heat applied by the fixing unit when fixing of the recording sheet is executed, wherein in the duplex printing, a first heat amount for fixing the toner image on an entire surface of the first side of the recording sheet is set to be smaller than a reference heat amount for the simplex printing whereas a second heat amount for fixing the toner image on an entire surface of the second side of the recording sheet is set to be larger than the reference heat amount.

2. The image forming apparatus according to claim 1, wherein the first heat amount represents a first fixing temperature, the second heat amount represents a second fixing temperature, and the reference heat amount represents a reference fixing temperature, and a sum of the first heat amount and the second heat amount set in the duplex printing is twice as large as the reference heat amount.

3. The image forming apparatus according to claim 2, wherein the heat amount setting section is configured to set the first heat amount and the second heat amount based on a sheet resistance of the recording sheet to be subjected to the duplex printing, and wherein the first heat amount is set to have a smaller value as the sheet resistance increases.

4. The image forming apparatus according to claim 3, wherein the heat amount setting section is configured to set the first heat amount and the second heat amount based on a transfer voltage at the transfer unit, and wherein the first heat amount is set to have a smaller value as an absolute value of the transfer voltage increases.

5. The image forming apparatus according to claim 2, wherein the heat amount setting section is configured to set the first heat amount and the second heat amount based on a sheet thickness of the recording sheet to be subjected to the duplex printing, and wherein the first heat amount is set to have a smaller value as the sheet thickness increases.

6. The image forming apparatus according to claim 5, wherein the heat amount setting section is configured to set the first heat amount and the second heat amount based on a transfer voltage at the transfer unit, and wherein the first heat amount is set to have a smaller value as an absolute value of the transfer voltage increases.

7. The image forming apparatus according to claim 2, wherein the heat amount setting section is configured to set the first heat amount and the second heat amount based on a transfer voltage at the transfer unit, and wherein the first heat amount is set to have a smaller value as an absolute value of the transfer voltage increases.

8. The image forming apparatus according to claim 2, wherein the heat amount setting section is configured to set the first heat amount and the second heat amount based on an amount of toner to be transferred to the recording sheet from the transfer unit, and wherein the first heat amount is set to have a smaller value as the amount of the toner increases.

9. The image forming apparatus according to claim 1, wherein the heat amount setting section is configured to set the first heat amount and the second heat amount based on a sheet resistance of the recording sheet to be subjected to the duplex printing, and wherein the first heat amount is set to have a smaller value as the sheet resistance increases.

10. The image forming apparatus according to claim 9, wherein the heat amount setting section is configured to set the first heat amount and the second heat amount based on a transfer voltage at the transfer unit, and wherein the first heat amount is set to have a smaller value as an absolute value of the transfer voltage increases.

11. The image forming apparatus according to claim 1, wherein the heat amount setting section is configured to set the first heat amount and the second heat amount based on a sheet thickness of the recording sheet to be subjected to the duplex printing, and wherein the first heat amount is set to have a smaller value as the sheet thickness increases.

12. The image forming apparatus according to claim 11, wherein the heat amount setting section is configured to set the first heat amount and the second heat amount based on a transfer voltage at the transfer unit, and wherein the first heat amount is set to have a smaller value as an absolute value of the transfer voltage increases.

13. The image forming apparatus according to claim 1, wherein the heat amount setting section is configured to set the first heat amount and the second heat amount based on a transfer voltage at the transfer unit, and wherein the first heat amount is set to have a smaller value as an absolute value of the transfer voltage increases.

14. The image forming apparatus according to claim 1, wherein the heat amount setting section is configured to set the first heat amount and the second heat amount based on an amount of toner to be transferred to the recording sheet from the transfer unit, and wherein the first heat amount is set to have a smaller value as the amount of the toner increases.

15. The image forming apparatus according to claim 1, wherein the heat amount setting section is configured to set the first heat amount and the second heat amount based on a printing image area in the recording sheet, and wherein the first heat amount is set to have a smaller value as the printing image area increases.

16. The image forming apparatus according to claim 1, further comprising a humidity sensor configured to detect a humidity inside of the image forming apparatus, wherein the heat amount setting section is configured to set the first heat amount and the second heat amount based on the humidity detected by the humidity sensor, and wherein the first heat amount is set to have a smaller value as the humidity inside of the image forming apparatus decreases.

17. The image forming apparatus according to claim 1, wherein the heat amount setting section is configured to set a fixing temperature at the fixing unit so as to set the first heat amount and the second heat amount.

18. The image forming apparatus according to claim 1, wherein the heat amount setting section is configured to set a conveyance speed of the recording sheet at the fixing unit so as to set the first heat amount and the second heat amount.

19. The image forming apparatus according to claim 1, wherein the heat amount setting section is configured to set a nip pressure to the recording sheet at the fixing unit so as to set the first heat amount and the second heat amount.

20. The image forming apparatus according to claim 1, wherein the heat amount setting section is configured to set the first heat amount to be equal to or larger than a glass transition temperature of the toner transferred to the recording sheet.

* * * * *